US010303116B2

(12) United States Patent
Inaba et al.

(10) Patent No.: US 10,303,116 B2
(45) Date of Patent: May 28, 2019

(54) ELECTROPHOTOGRAPHIC IMAGE FORMING APPARATUS HAVING A DRIVING-FORCE TRANSMISSION MEMBER FEATURING FIRST AND SECOND HELICAL GEAR PORTIONS WITH OPPOSING TWIST DIRECTIONS

(71) Applicant: CANON KABUSHIKI KAISHA, Tokyo (JP)

(72) Inventors: Yuichiro Inaba, Chigasaki (JP); Tetsuji Suzuki, Fujisawa (JP); Yoshihiro Ito, Mishima (JP); Ryuta Murakami, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/615,708

(22) Filed: Jun. 6, 2017

(65) Prior Publication Data

US 2017/0357210 A1 Dec. 14, 2017

(30) Foreign Application Priority Data

Jun. 14, 2016 (JP) ..... 2016-118182

(51) Int. Cl.
*G03G 21/16* (2006.01)
*G03G 21/18* (2006.01)
*G03G 15/00* (2006.01)

(52) U.S. Cl.
CPC ..... *G03G 21/1857* (2013.01); *G03G 15/757* (2013.01); *G03G 21/1647* (2013.01); *G03G 21/186* (2013.01); *G03G 2221/1657* (2013.01)

(58) Field of Classification Search
CPC ..... G03G 21/186
(Continued)

(56) References Cited

U.S. PATENT DOCUMENTS 5,926,673 A 7/1999 Foster et al.
2003/0053823 A1* 3/2003 Cho ..... F16D 1/101 399/167

(Continued)

FOREIGN PATENT DOCUMENTS

CN 1452033 A 10/2003
CN 202067077 U 12/2011

(Continued)

OTHER PUBLICATIONS

Zhao, Changjun. Translation of CN202421742. Published Sep. 2012. Translated May 2018.*

*Primary Examiner* — Walter L Lindsay, Jr.
*Assistant Examiner* — Philipmarcus T Fadul
(74) *Attorney, Agent, or Firm* — Canon U.S.A., Inc. IP Division

(57) ABSTRACT

A driving-force transmission member includes a coupling portion that includes a driving-force transmission surface and that transmits a driving force to a cartridge coupling, a first helical gear portion that engages with a driven gear of a cartridge to transmit the driving force, and a second helical gear portion that engages with a drive gear to receive the driving force. The portions rotate integrally with each other when the driving-force transmission member rotates about the axis of rotation. The driving-force transmission surface is shaped with a twist in the same direction as the driving-force transmission member. Helical teeth of the first helical gear portion are shaped with a twist in the same direction as the driving-force transmission surface. Helical teeth of the second helical gear portion are shaped with a twist in a direction opposite to the twist direction of the helical teeth of the first helical gear portion.

19 Claims, 22 Drawing Sheets

(58) Field of Classification Search
USPC ..... 399/167
See application file for complete search history.

(56) References Cited

U.S. PATENT DOCUMENTS

| | | | | |
|---|---|---|---|---|
| 2003/0235429 | A1 | 12/2003 | Sato | |
| 2012/0257906 | A1* | 10/2012 | Zhao | F16D 3/20 399/111 |
| 2014/0037336 | A1 | 2/2014 | Yan Mei | |
| 2015/0212456 | A1 | 7/2015 | Imaizumi | |

FOREIGN PATENT DOCUMENTS

| | | | | | |
|---|---|---|---|---|---|
| CN | 202421742 | | * | 9/2012 | G03G 21/18 |
| CN | 203259776 | U | | 10/2013 | |
| JP | H08262951 | A | | 10/1996 | |
| JP | H08328449 | A | | 12/1996 | |
| JP | H11265129 | A | | 9/1999 | |
| JP | 2002258674 | A | | 9/2002 | |
| JP | 2010032917 | A | | 2/2010 | |
| JP | 2013061403 | A | | 4/2013 | |

* cited by examiner

ELECTROPHOTOGRAPHIC IMAGE FORMING APPARATUS HAVING A DRIVING-FORCE TRANSMISSION MEMBER FEATURING FIRST AND SECOND HELICAL GEAR PORTIONS WITH OPPOSING TWIST DIRECTIONS

BACKGROUND OF THE INVENTION

Field of the Invention

The present disclosure relates to an electrophotographic image forming apparatus for forming an image on a recording medium using an electrophotographic system, with a cartridge mounted therein.

Description of the Related Art

In an electrophotographic image forming apparatus (hereinafter simply referred to as "image forming apparatus"), an electrophotographic photosensitive member serving as an image bearing member, which is generally drum shaped, that is, a photosensitive drum, is uniformly charged with electricity. Next, the charged photosensitive drum is selectively exposed to light to form an electrostatic latent image (an electrostatic image) on the photosensitive drum. Then, the electrostatic latent image formed on the photosensitive drum is developed into a toner image with toner serving as a developer. The toner image formed on the photosensitive drum is transferred to a recording medium, such as recording paper or a plastic sheet, the toner image transferred onto the recording medium is then subjected to heat or pressure so that the toner image is fixed to the recording medium, and thus the image is printed.

Such image forming apparatuses generally need replenishing of toner and maintenance of various processing units. To facilitate the replenishing of toner and the maintenance, a process cartridge in which a photosensitive drum, a charging unit, a developing unit, a cleaning unit, and so on are combined in a frame and which is detachably mounted to an image forming apparatus main body is in practical use.

This process cartridge system remarkably enhances the operability because a user can perform maintenance by himself/herself, thus providing an image forming apparatus having excellent usability. For this reason, this process cartridge system is widely used in image forming apparatuses.

Japanese Patent Laid-Open No. 8-328449 discloses an image forming apparatus including a driving-force transmission member that includes a coupling that transmits drive to a process cartridge from an image forming apparatus main body at an end and that is urged toward the process cartridge by a spring. This image forming apparatus is configured such that, when the operable cover of the image forming apparatus main body is closed, the driving-force transmission member is pushed by the spring and moves toward the process cartridge into engagement with a coupling of the process cartridge to transmit the driving force. Furthermore, when the openable cover of the image forming apparatus main body is opened, the driving-force transmission member is moved away from the process cartridge against the spring by a cam into a detachable state.

SUMMARY OF THE INVENTION

The present disclosure is intended to develop the related art and provides a configuration in which the driving-force transmission member can be positioned with stability in the direction of the axis of rotation.

In another aspect of the present disclosure, the following electrophotographic image forming apparatus is provided.

The electrophotographic image forming apparatus forms an image an a recording medium in a state in which a cartridge is mounted to an apparatus main body. The apparatus includes a drive source, a drive gear, and a driving-force transmission member. The drive gear is configured to be rotated by the drive source. The driving-force transmission member is configured to be rotated by a driving force transmitted from the drive gear to transmit the driving force to the cartridge. The driving-force transmission member includes a coupling portion, a first helical gear portion, and a second helical gear portion. The coupling portion includes a driving-force transmission surface configured to engage with a cartridge coupling of the cartridge and transmits the driving force to the cartridge coupling. The first helical gear portion is configured to engage with a driven gear of the cartridge to transmit the driving force. The second helical gear portion is configured to engage with the drive gear to receive the driving force. The coupling portion, the first helical gear portion, and the second helical gear portion rotate integrally with each other when the driving-force transmission member rotates about an axis of rotation. The driving-force transmission surface of the coupling portion is shaped with a twist in a same direction as a rotation direction of the driving-force transmission member from a downstream side to an upstream side in a predetermined direction parallel to the axis of rotation when the driving-force transmission member is viewed in the predetermined direction from the cartridge coupling. Helical teeth of the first helical gear portion are shaped with a twist in a same direction as a twist direction of the driving-force transmission surface. Helical teeth of the second helical gear portion are shaped with a twist in a direction opposite to the twist direction of the helical teeth of the first helical gear portion.

Further features of the present invention will become apparent from the following description of exemplary embodiments (with reference to the attached drawings).

DESCRIPTION OF THE EMBODIMENTS

First Embodiment

An embodiment of the present disclosure will be described. In the following description, an apparatus main body A refers to a part of the electrophotographic image forming apparatus excluding a cartridge B. A longitudinal direction AM is defined as the direction of the axis of rotation of an electrophotographic photosensitive drum 62 in a state in which the cartridge B is mounted in the apparatus main body A. A side on which a driving-force transmission member 81 that transmits drive from the image forming apparatus main body A to the electrophotography photosensitive drum 62 in the longitudinal direction AM of the apparatus main body A is defined as a drive side, and the opposite side is defined as a non-drive side.

Figure 1:
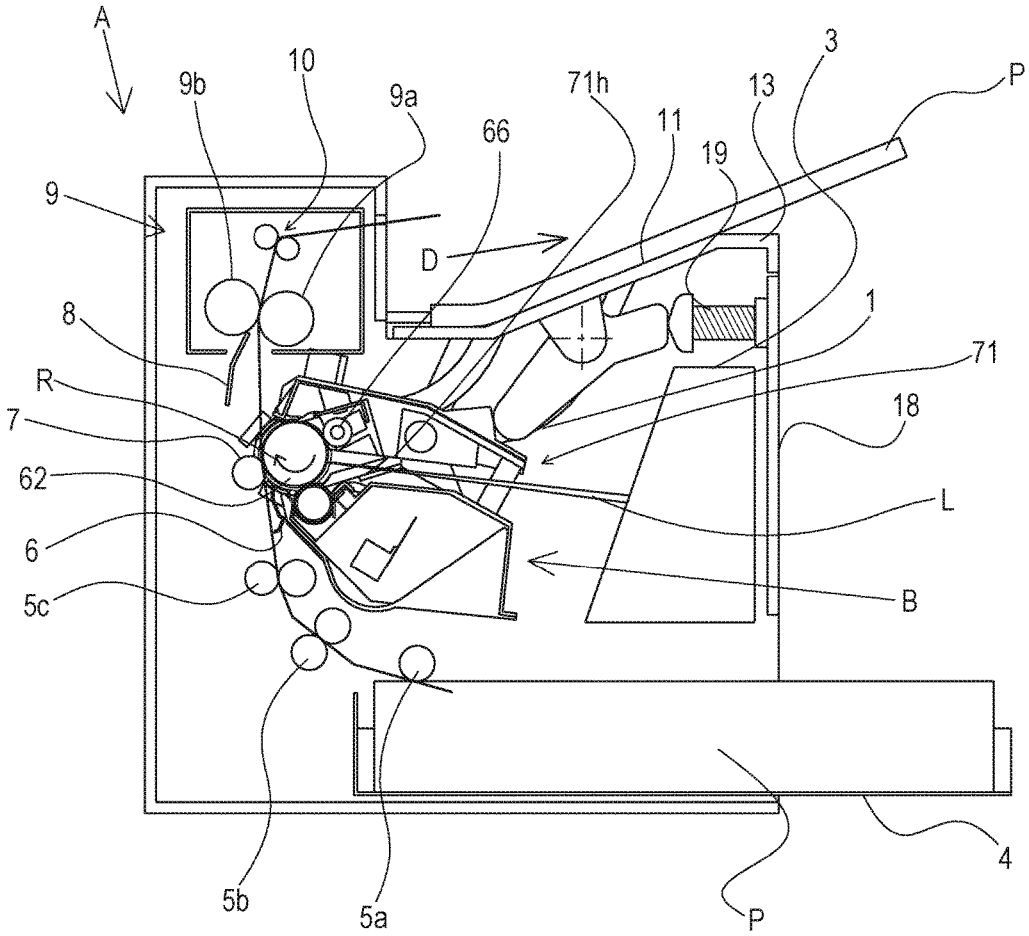
FIG. 1 is a cross-sectional view of an electrophotographic image forming apparatus in a state in which a cartridge is mounted, perpendicular to the axis of rotation of a drum.
Figure 2:
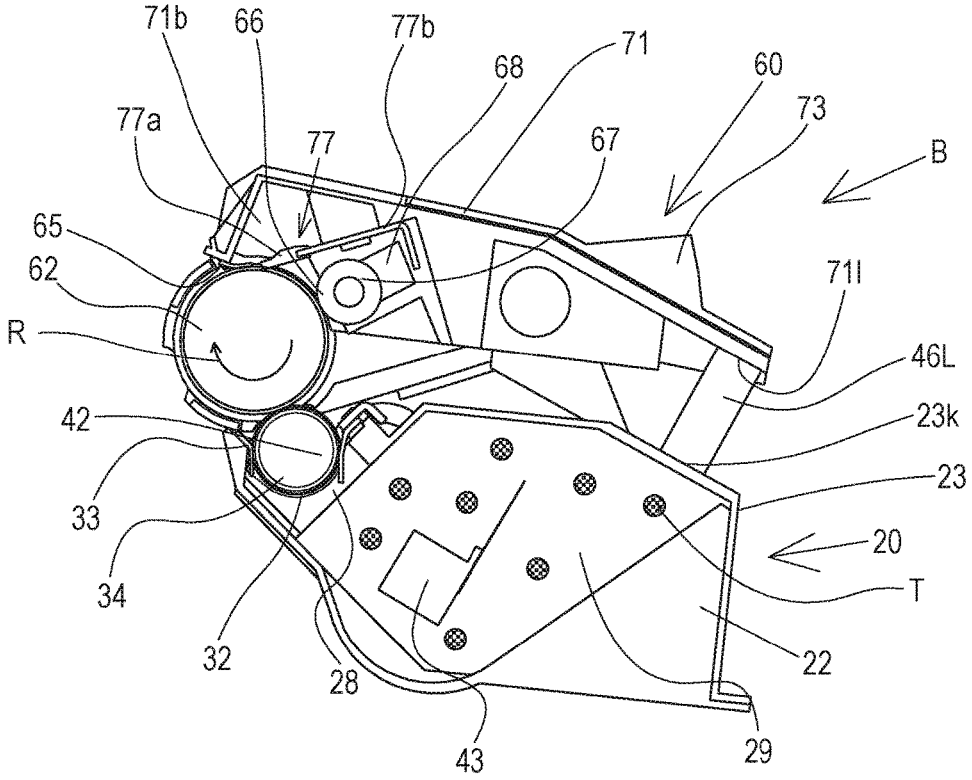
FIG. 2 is a cross-sectional view of the cartridge perpendicular to the axis of rotation of the drum.

Referring to FIGS. 1 and 2, the overall configuration and the image forming process will be described. FIG. 1 is a cross-sectional view of the image forming apparatus main body of the electrophotographic image forming apparatus (hereinafter referred to as "apparatus main body A") and a process cartridge (hereinafter referred to as "cartridge B") according to an embodiment of the present disclosure. FIG. 2 is a cross-sectional view of the cartridge B. Both FIGS. 1 and 2 are cross-sectional views perpendicular to the axis of rotation of the electrophotographic photosensitive drum 62.

Overall Configuration of Electrophotographic Image Forming Apparatus

The electrophotographic image forming apparatus illustrated in FIG. 1 is a laser beam printer using an electrophotography technique in which the cartridge B is detachable from the apparatus main body A. When the cartridge B is mounted to the apparatus main body A, an exposing unit 3 for forming a latent image on the electrophotographic photosensitive drum 62 serving as an image bearing member of the cartridge B is disposed. A sheet tray 4 that contains recording media (hereinafter referred to as "sheet material P") on which an image is to be formed is disposed below the cartridge B.

The apparatus main body A further includes a pick-up roller 5*a*, a feed roller pair 5*b*, a conveying roller pair 5*c*, a transfer guide 6, a transfer roller 7, a conveyance guide 8, a fixing unit 9, a discharge roller pair 10, an output tray 11, and so on in the conveying direction D of the sheet material P. The fixing unit 9 is constituted of a heating roller 9*a* and a pressure roller 9*b*.

Image Forming Process

The outline of the image forming process will be described. The electrophotographic photosensitive drum (hereinafter referred to as "drum 62") is rotationally driven at a predetermined circumferential speed (process speed) in the direction of arrow R on the basis of a print start signal. A charging roller 66 to which a bias voltage is applied comes into contact with the outer circumferential surface of the drum 62 to uniformly charge the outer circumferential surface of the drum 62.

The exposing unit 3 outputs a laser beam L according to image information. The laser beam L passes through a laser opening 71*h* provided in a cleaning housing 71 of the cartridge B to scan the outer circumferential surface of the drum 62 for exposure. Thus an electrostatic latent image corresponding to the image information is formed on the outer circumferential surface of the drum 62.

Referring now to FIG. 2, in a developing unit 20, toner T in a toner chamber 29 is stirred and conveyed by the rotation of a conveying member 43 into a toner supply chamber 28. The toner T is born on the surface of a developing roller 32 by the magnetic force of a magnet roller 34 (a fixed magnet). The toner T on the circumferential surface of the developing roller 32 serving as a developer bearing member is adjusted in layer thickness while being triboelectrically charged by a developing blade 42. The toner T is developed on the drum 62 according to the electrostatic latent image and is visualized as a toner image.

As illustrated in FIG. 1, the sheet material P contained at the lower part of the apparatus main body A is fed out of the sheet tray 4 by the pick-up roller 5*a*, the feed roller pair 5*b*, and the conveying roller pair 5*c* together with the output timing of the laser beam L. The sheet material P passes through the transfer guide 6 and is conveyed to a transfer position between the drum 62 and the transfer roller 7. At the transfer position, the toner image is sequentially transferred from the drum 62 to the sheet material P.

The sheet material P to which the toner image is transferred is separated from the drum 62 and is conveyed to the fixing unit 9 along the conveyance guide 8. The sheet material P then passes through a nip between the heating roller 9*a* and the pressure roller 9*b* that constitute the fixing unit 9. The toner image subjected to a pressing and heating fixing process at the nip is fixed to the sheet material P. The sheet material P subjected to the toner-image fixing process is conveyed to the discharge roller pair 10 and is discharged onto the output tray 11.

Referring to FIG. 2, residual toner on the outer circumferential surface of the drum 62 after the transfer is removed by a cleaning member (cleaning blade) 77 and is used again for the image forming process. The toner removed from the drum 62 is stored in a waste-toner chamber 71*b* of a cleaning unit 60, which is a housing including the photosensitive drum 62.

In the above description, the charging roller 66, the developing roller 32, the transfer roller 7, and the cleaning member 77 constitute a processing unit working on the drum 62.

Cartridge Configuration

Figure 3:
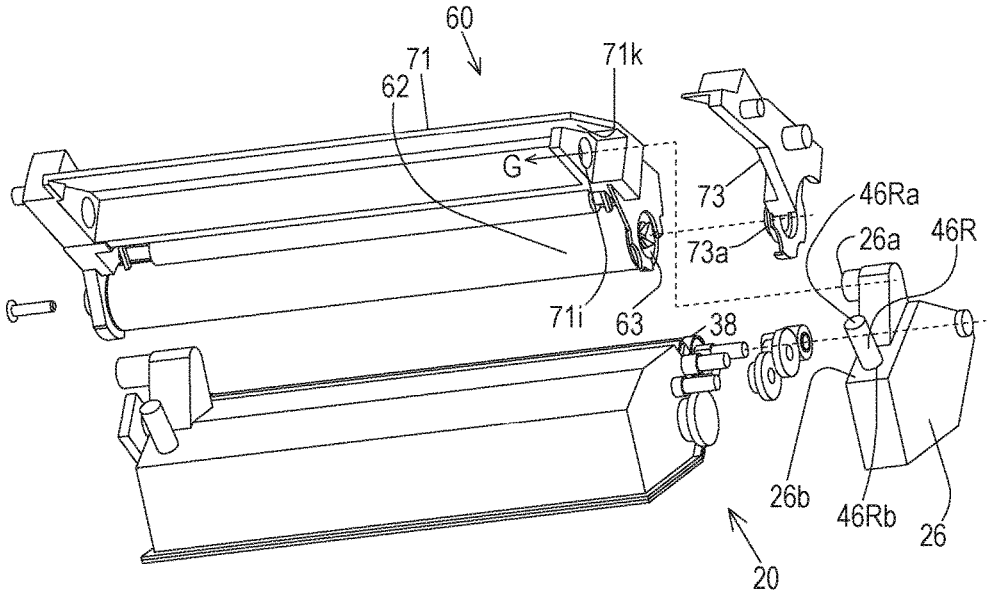
FIG. 3 is an exploded perspective view of the cartridge.
Figure 4:
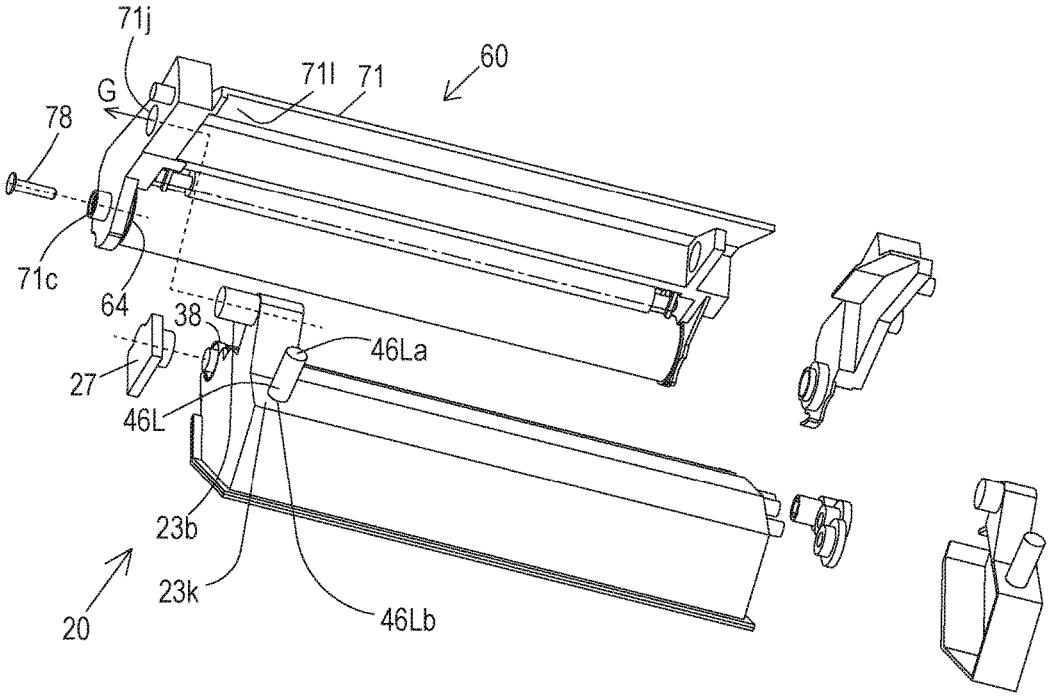
FIG. 4 is an exploded perspective view of the cartridge.

The overall configuration of the cartridge B be described with reference to FIGS. 2, 3, and 4. FIG. 2 is a cross-sectional view of the cartridge B, and FIGS. 3 and 4 are exploded perspective views of part of the cartridge B.

The cartridge B is what is called a process cartridge including the cleaning unit 60 and the developing unit 20. The process cartridge is an integrated combination of an electrophotographic photosensitive member and a processing unit for processing the electrophotographic photosensitive member, including at least one of a charging device, a developing device, and a cleaning unit and is detachably mounted to the main body of an electrophotographic image forming apparatus.

The cleaning unit 60 includes the drum 62, the charging roller 66, the cleaning member 77, and the cleaning housing 71 that supports them. As illustrated in FIG. 3, the drum 62 is supported such that a drive-side drum flange 63 provided at a drive-side end is rotatable in a hole 73*a* in a drum bearing 73. On the non-drive side, as illustrated in FIG. 4, the drum 62 is supported by a drum shaft 78 press-fitted in a hole 71*c* in the cleaning housing 71 so as to be rotatable in a hole (not shown) of a non-drive-side drum flange 64. In the cleaning unit 60, the charging roller 66 and the cleaning member 77 are disposed in contact with the outer circumferential surface of the drum 62.

The cleaning member 77 includes a rubber blade 77*a*, which is a blade-like elastic member formed of rubber, or an elastic material, and a supporting member 77*b* that supports the rubber blade 77*a*. The rubber blade 77*a* is in contact with the drum 62 counter to the rotation direction of the drum 62. In other words, the rubber blade 77*a* is in contact with the drum 62 such that its distal end is directed upstream of the rotation direction of the drum 62.

The waste toner removed from the surface of the drum 62 by the cleaning member 77 is stored in the waste-toner chamber 71*b* formed by the cleaning housing 71 and the cleaning member 77. A leakproof sheet 65 for preventing the waste toner from leaking from the cleaning housing 71 is disposed at the edge of the cleaning housing 71 so as to be in contact with the drum 62.

The charging roller 66 is rotatably mounted to the cleaning unit 60 via charging-roller bearings 67 at both ends of the cleaning housing 71 in the longitudinal direction (substantially parallel to the axis of rotation of the drum 62). The charging roller 66 is brought into pressure-contact with the drum 62 because the charging-roller bearings 67 are pushed toward the drum 62 by urging members 68. The charging roller 66 is rotated with the rotation of the drum 62.

The developing unit 20 includes the developing roller 32, a developer container 23 that supports the developing roller 32, a developing blade 42, and so on. The developing roller 32 is rotatable mounted to the developer container 23 using bearing members 26 and 27 provided at both ends. The developing roller 32 includes a magnet roller 34 therein. The developing unit 20 includes the developing blade 42 for adjusting the toner layer on the developing roller 32. Roller-shaped space holding members 38 are rotatably attached to both ends of the developing roller 32. The space holding members 38 and the drum 62 are in contact with each other so that the developing roller 32 is held with a slight clearance from the drum 62. A leakproof sheet 33 for preventing toner from leaking from the developing unit 20 is disposed at the edge of a bottom member 22 so as to be in contact with the developing roller 32. The toner chamber 29 formed by the developer container 23 and the bottom member 22 is provided with the conveying member 43. The conveying member 43 stirs the toner contained in the toner chamber 29 and conveys the toner to the toner supply chamber 28.

As illustrated in FIGS. 3 and 4, the cartridge B is constituted by combining the cleaning unit 60 and the developing unit 20. In combining the developing unit and the cleaning unit, the center of a development first support boss 26*a* of the developer container 23 corresponding to a first hanging hole 71*i* on the drive side of the cleaning housing 71 and the center of a development second support boss 23*b* corresponding to a second hanging hole 71*j* on the non-drive side are aligned. Specifically, the developing unit 20 is moved in the direction of arrow G, so that the development first support boss 26*a* and the development second support boss 23*b* are respectively fitted in the first hanging hole 71*i* and the second hanging hole 71*j*. Thus, the developing unit 20 is rotatably connected to the cleaning unit 60. Subsequently, the drum bearing 73 is combined with the cleaning unit 60 to form the cartridge B.

A first end 46Lb of an urging member 46L on the non-drive side is fixed to a surface 23*k* of the developer container 23, and a second end 46La comes into contact with a surface 71*l*, which is a part of the cleaning unit 60. A first end 46Rb of an urging member 46R on the drive side is fixed to a surface 26*h* of the bearing member 26, and a second end 46Ra comes into contact with a surface 71*k*, which is part of the cleaning unit 60.

In the present embodiment, the urging member 46R and the urging member 46L are compressed springs. By urging the developing unit 20 against the cleaning unit 60 by the urging force of the springs, the developing roller 32 is reliably pushed against the drum 62. The developing roller 32 is held at a predetermined interval from the drum 62 by the space holding members 38 attached to both ends of the developing roller 32.

Configuration of Apparatus Main Body

Figure 5:
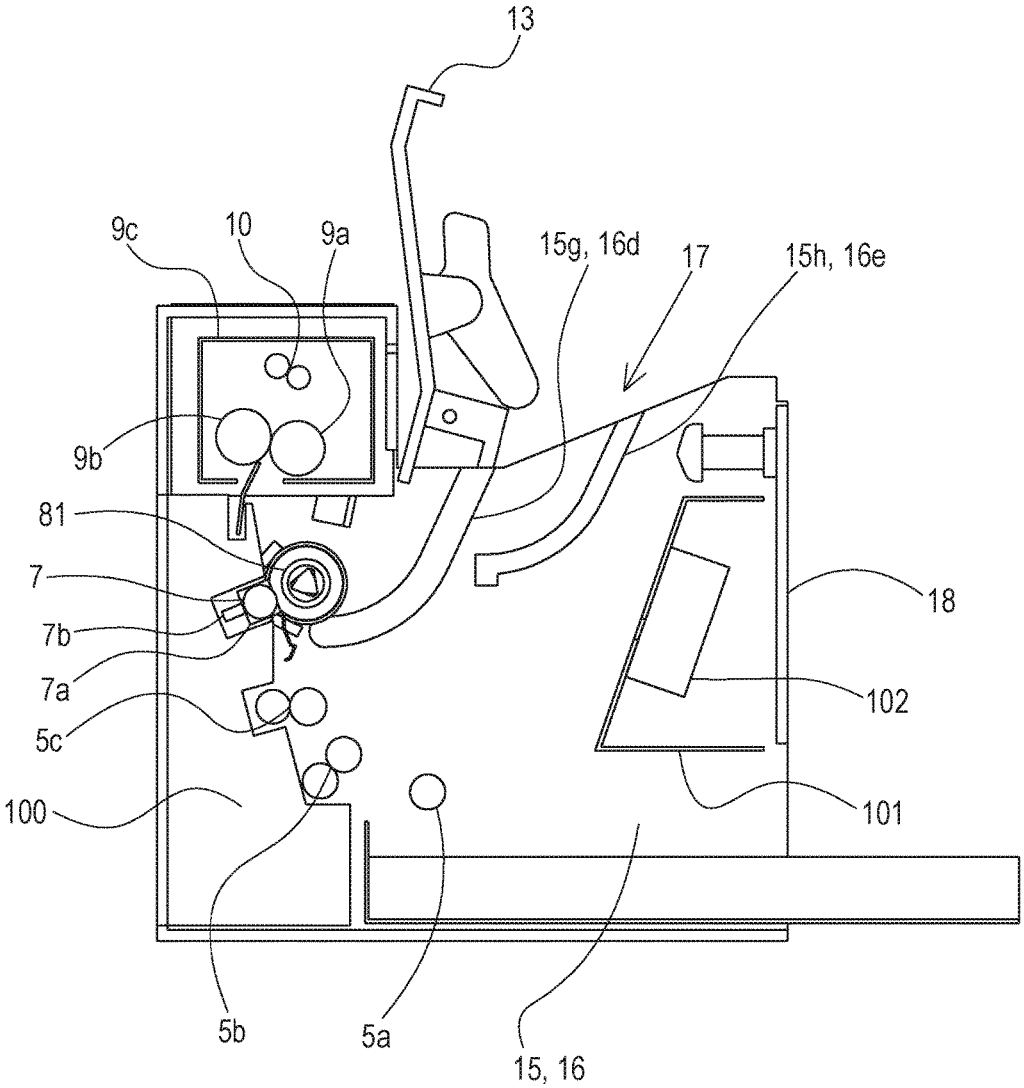
FIG. 5 is across-sectional view of the apparatus main body perpendicular to the axis of rotation of the drum.
Figure 6:
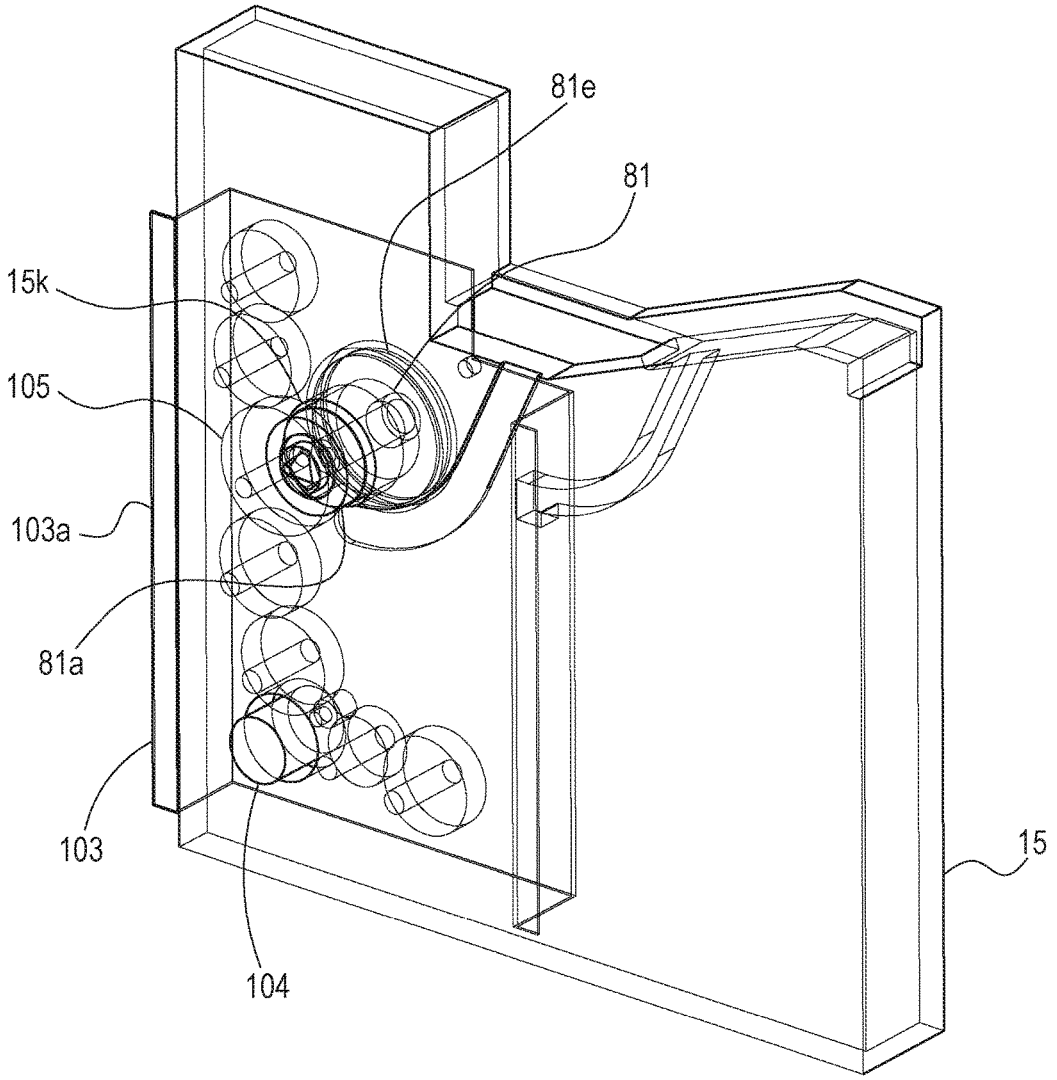
FIG. 6 is a perspective view of a drive unit.

Referring next to FIGS. 5 and 6, the configuration of the apparatus main body A will be described. FIG. 5 is a cross-sectional view of the apparatus main body A, and FIG. 6 is a perspective view of a drive unit. The cross section of FIG. 5 is perpendicular to the axis of rotation of the drum 62.

Figure 8:
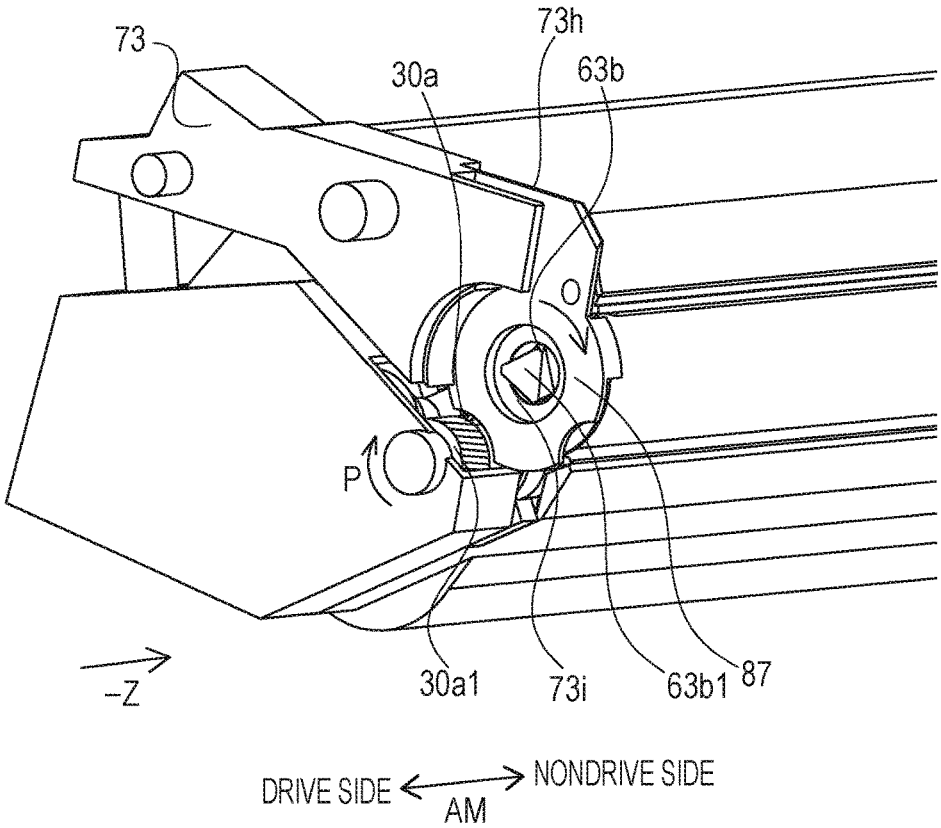
FIG. 8 is a partial perspective view of the drive side of the cartridge.
Figure 17:
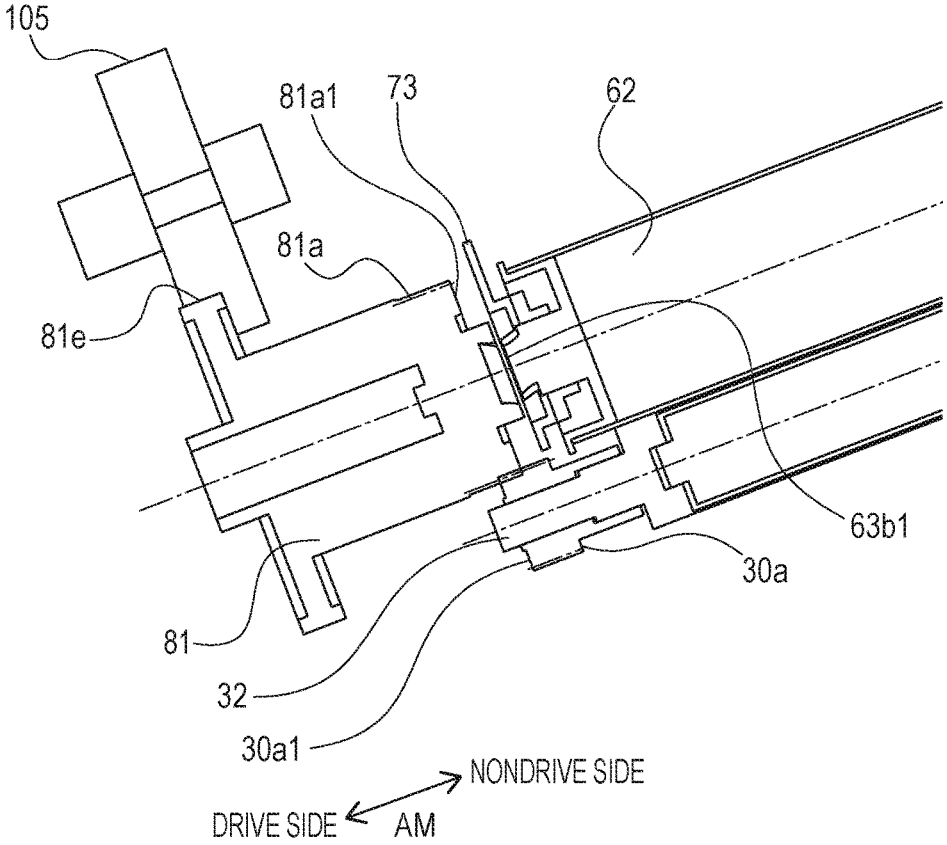
FIG. 17 is a diagram illustrating the position in the longitudinal direction of the driving-force transmission member before the openable cover is closed.

The apparatus main body A has a casing formed of plastic or the like. The casing is made up of a side plate 15 on the drive side, a side plate 16 on the non-drive side, and a front plate 18 and a back plate 100 connecting the side plates 15 and 16 together. The apparatus main body A includes an openable cover 13 supported so as to be rotatable with respect to the casing. The cartridge B becomes detachable from the apparatus main body A through a cartridge insertion opening 17 which is exposed by opening the openable cover 13. Upper guide rails 15*g* and 16*d* and lower guide rails 15*h* and 16*e* that guide the cartridge B at the attachment and detachment of the cartridge B, which will be described in detail in FIGS. 8 and 17, are respectively disposed inside the side plates 15 and 16 of the apparatus main body A. The exposing unit 3 is constituted of a laser scanner 102 supported and fixed by an optical support 101 fixed so as to connect the side plate 15 and the side plate 16 using screws or the like (not shown).

Drive Unit

Referring to FIG. 6, the configuration of a drive unit 103 will be described. The drive unit 103 includes a plurality of gears that are rotatably supported by a drive-unit side plate 103*a* and is supported and fixed at a position of the side plate 15 outside the apparatus main body A using screws or the like (not shown). The drive unit 103 includes a motor 104 serving as a drive source. The plurality of gears constitute a driving-force transmission gear train (a drive train). The driving-force transmission gear train supplies a driving force from the motor 104 to the pick-up roller 5*a*, the feed roller pair 5*b*, the conveying roller pair 5*c*, the driving-force transmission member 81, the pressure roller 9*b*, and the discharge roller pair 10, illustrated in FIG. 5. The pick-up roller 5*a* includes a solenoid (not shown) in the drive train and is intermittently driven at the synchronous timing with a print start signal. The feed roller pair 5*b* and the conveying roller pair 5*c* are rotating all the time and transfers the sheet material P fed from the pick-up roller 5*a* to a transfer portion.

The driving force is supplied to the cartridge B by the driving force transmission member 81. A second gear portion 81*e* of the driving-force transmission member 81 engages with a drive gear 105 that is rotated by the driving force transmitted from the motor 104 via the gears on the outside of the side plate 15, so that the driving force from the motor 104 is transmitted thereto. A coupling recess 81*b* and a first gear portion 81*a* protrude from a hole 15*k* provided in the side plate 15 to the inside of the side plate 15 so that the driving force can be transmitted to the cartridge B.

The transfer roller 7 is rotatably mounted to the back plate 100 via bearing members 7*a* at both ends. The transfer roller 7 is configured to apply a predetermined contact pressure to the photosensitive drum 62 using transfer pressure springs 7*b* attached to the bearing members 7*a*. The transfer roller 7 comes into contact with the photosensitive drum 62 to form a transfer nip and conveys the sheet material P conveyed from the conveying roller pair 5*c* to the fixing unit 9 while transferring the toner image. The transfer roller 7 is not connected to the drive train and is driven by the photosensitive drum 62.

The pressure roller 9*b* and the heating roller 9*a* are fixed to a fixing frame 9*c* to form the fixing unit 9. The fixing frame 9*c* is fixed to the upper surfaces of the side plate 15 and the side plate 16 using screws or the like (not shown). In the fixing unit 9, a pressure-roller drive gear (not shown) is fixed to one end of the pressure roller 9*b*. The pressure roller 9*b* rotates by receiving the driving force from the motor 104 serving as a drive source via the drive train. The sheet material P conveyed from the transfer portion is conveyed to the discharge roller pair 10 while the toner image is fixed to the sheet material P through the fixing roller pair.

Configuration of Vicinity of Driving-Force Transmission Member 81

Figure 15:
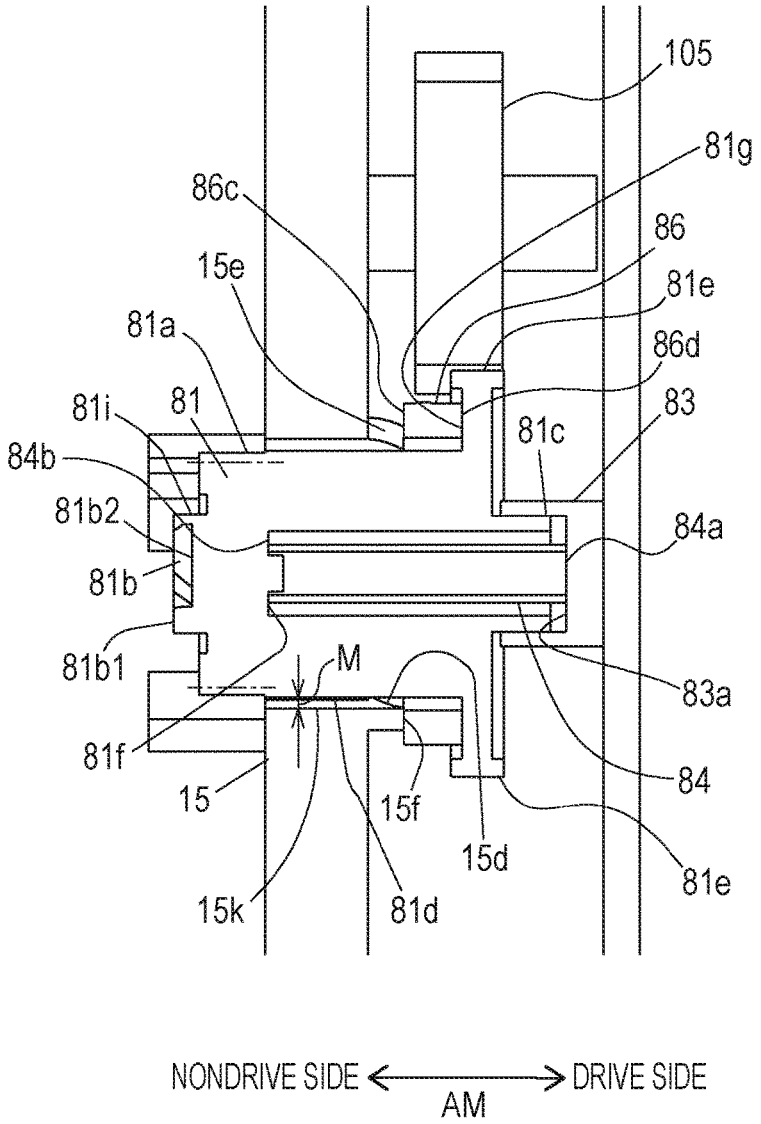
FIG. 15 is a cross-sectional view of the vicinity of the driving-force transmission member parallel to the axis of rotation of the drum.

Next, the configuration of the driving-force transmission member 81 and the vicinity thereof will be described. FIG. 15 is a cross-sectional view of the vicinity of the driving-force transmission member 81 parallel to the axis of rotation of the drum 62. As illustrated in FIG. 15, the driving-force transmission member 81, a driving-force-transmission-member bearing 83 that rotatably supports the driving-force transmission member 81, a driving-force-transmission-member urging spring 84, a cylindrical cam 86, and the side plate 15 are provided on the drive side of the apparatus main body A.

Driving-Force Transmission Member 81

Figure 7:
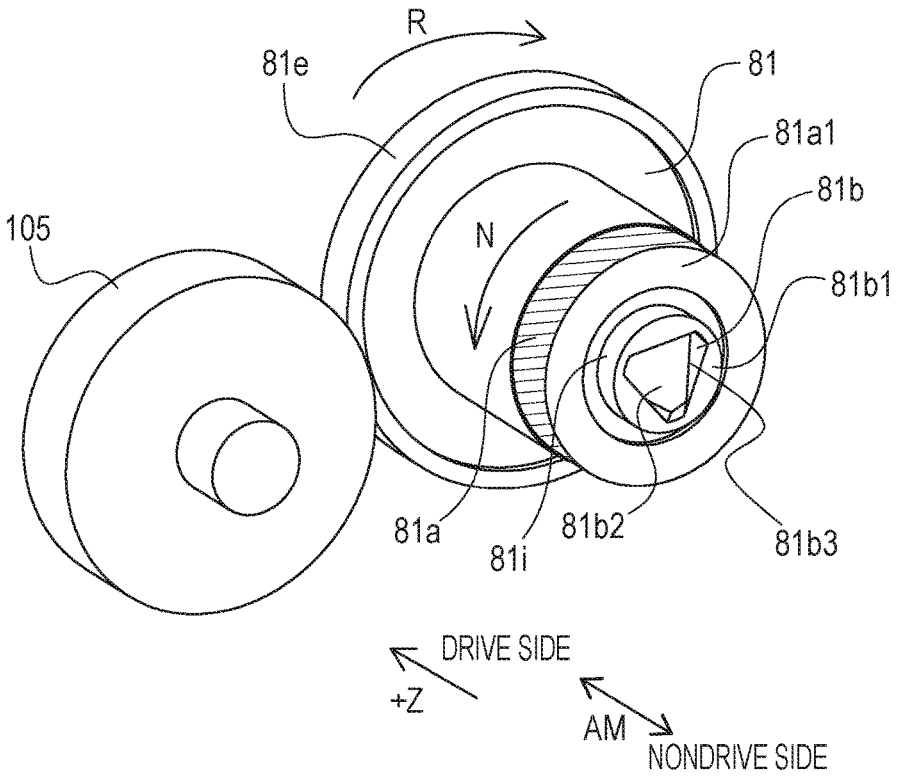
FIG. 7 is a perspective view of a driving-force transmission member and a drive gear.

Next, the configuration of the driving-force transmission member 81 will be described with reference to FIGS. 7 and 15. FIG. 7 is a perspective view of the driving-force transmission member 81 and the drive gear 105. As illustrated in FIG. 15, a drive-side end 81*c* of the driving-force transmission member 81 in the axial direction parallel to the longitudinal direction AM engages with the driving-force-transmission-member bearing 83 and is supported so as to be rotatable and movable in the axial direction.

A central portion 81*d* of the driving-force transmission member 81 in the longitudinal direction AM has a clearance M from the hole 15*k* in the side plate 15. The driving-force transmission member 81 is supported so as to be slightly movable within the clearance M when the cartridge B is not mounted to the apparatus main body A. The following description is made on the assumption that the axis of rotation of the driving-force transmission member 81 is parallel to the longitudinal direction AM.

The driving-force transmission member 81 includes the first gear portion 81*a* (a first helical gear portion), the second gear portion (a second helical gear portion) 81*e*, and the coupling recess 81*b* on the non-drive side. A distal end 81*b*1 is provided at the distal end of the coupling recess 81*b*. In the driving-force transmission member 81, the coupling recess 81*b*, the first gear portion 81*a*, and the second gear portion 81*e* are disposed in that order from the non-drive side to the drive side in the longitudinal direction AM.

Cylindrical Cam 86

Figure 11:
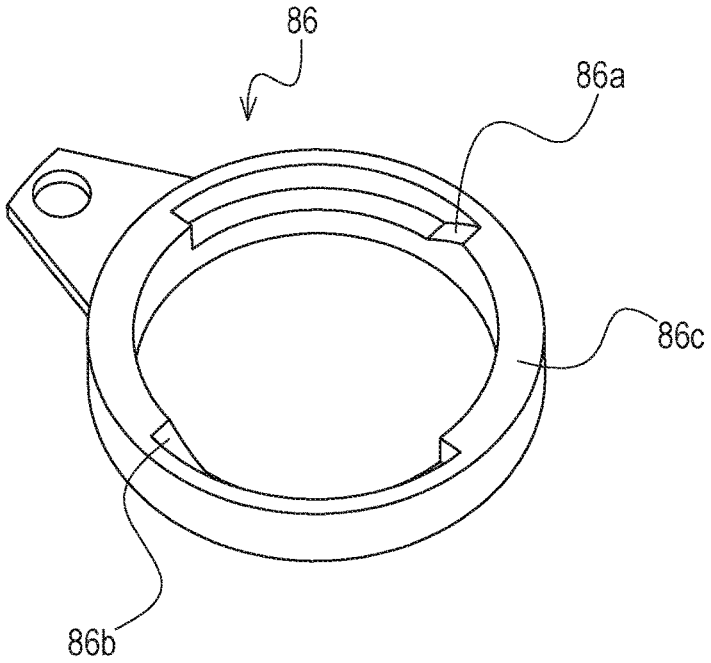
FIG. 11 is a perspective view of a cylindrical cam.
Figure 12:
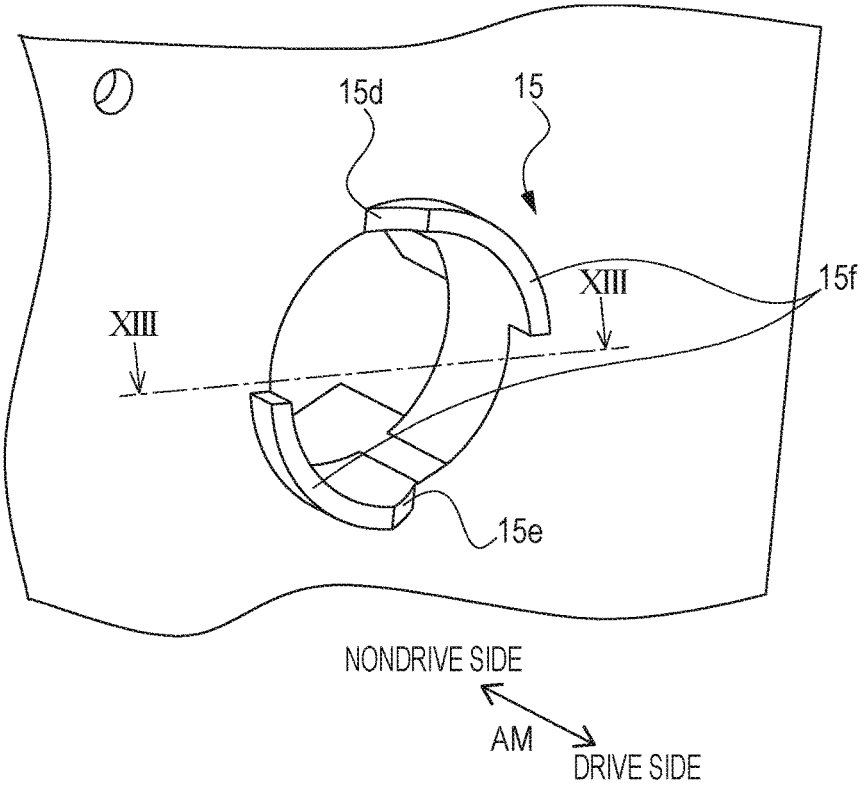
FIG. 12 is a perspective view of a side plate as viewed from the drive side.
Figure 13:
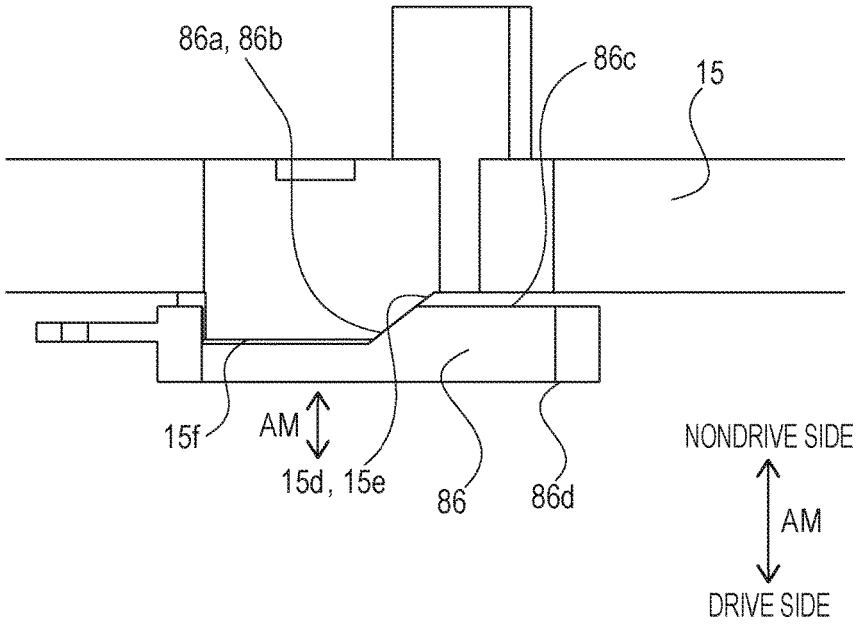
FIG. 13 is a cross-sectional view of the side plate on which the cylindrical cam is attached, taken along the axis of rotation of the drum (as viewed from the direction of arrow XIII in FIG. 12).

Next, the cylindrical cam 86 for moving the driving-force transmission member 81 in the longitudinal direction AM will be described. FIG. 11 is a perspective view of the cylindrical cam 86, and FIG. 12 is a perspective view of the side plate 15 as viewed from the drive side. As illustrated in FIGS. 11 and 12, the cylindrical cam 86 is attached to the side plate 15 so as to be rotatable and movable in the longitudinal direction AM. The cylindrical cam 86 includes two inclined surfaces 86*a* and 86*b* and a first end 86*c* continuous with the inclined surfaces 86*a* and 86*b* and parallel to the side plate 15 on the non-drive side in the longitudinal direction. As illustrated in FIGS. 12 and 13, the side plate 15 includes two inclined surfaces 15*d* and 15*e* at positions facing the two inclined surfaces 86*a* and 86*b* and end faces 15*f* that can face the first end 86*c* of the cylindrical cam 86. The cylindrical cam 86 has a second end 86*d* opposite to the first end 86*c*.

Figure 14:
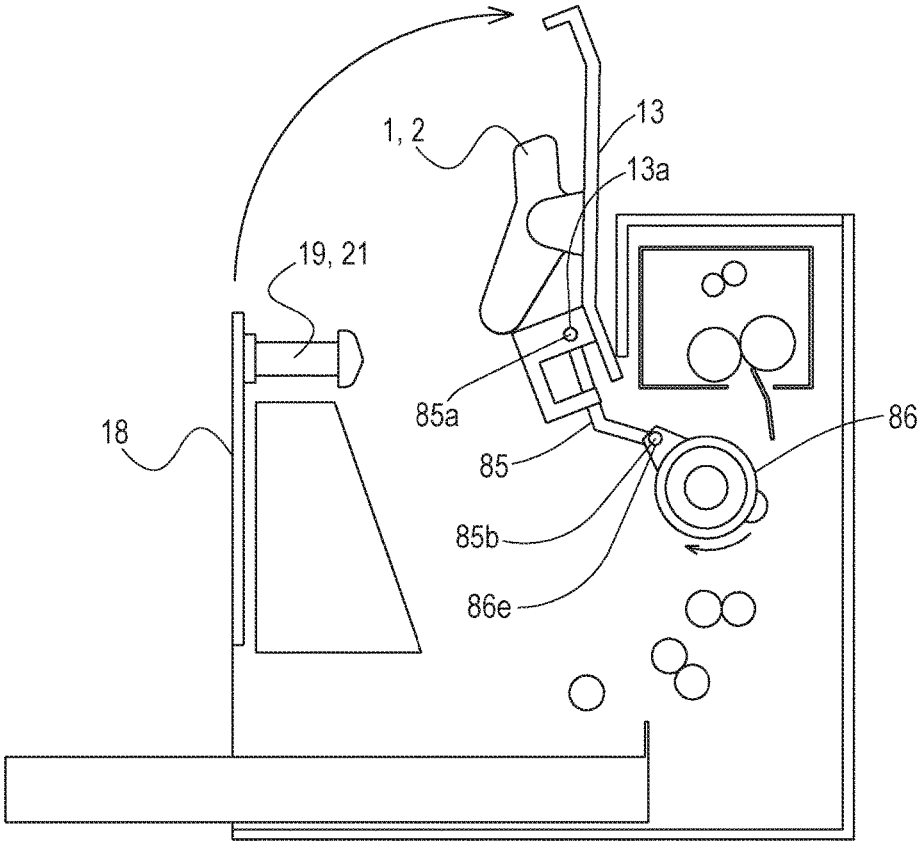
FIG. 14 is a cross-sectional view of the apparatus main body perpendicular to the axis of rotation of the drum for illustrating the link configuration of the cylindrical cam in a state in which the openable cover is open.

FIG. 14 is a cross-sectional view of the apparatus main body A perpendicular to the axis of rotation of the drum 62 for illustrating the link configuration of the cylindrical cam 86 in a state in which the openable cover 13, which is opened to replace the cartridge B, is open. The apparatus main body A includes a link member 85 connected to the openable cover 13 and the cylindrical cam 86, cartridge pressing members 1 and 2, cartridge pressing springs 19 and 21, and the front plate 18. The openable cover 13 is rotatable attached to the side plate 15 and the side plate 16 (not shown). The link member 85 includes bosses 85*a* and 85*b* at both ends. The bosses 85*a* and 85*b* are respectively rotatably mounted to a mounting hole 13*a* of the openable cover 13 and a mounting hole 86*e* of the cylindrical cam 86. When the openable cover 13 is opened, the cylindrical cam 86 rotates via the link member 85 until the first end 86*c* of the cylindrical cam 86 and the end faces 15*f* of the side plate 15 come into contact with each other. While the cylindrical cam 86 rotates until the first end 86*c* of the cylindrical cam 86 and the end faces 15*f* of the side plate 15 come into contact with each other, the cylindrical cam 86 moves to the drive side in the longitudinal direction AM while the inclined surfaces 86*a* and 86*b* are respectively in contact with the inclined surfaces 15*d* and 15*e*.

As illustrated in FIG. 15, the driving-force transmission member 81 includes a butting surface 81*g*. The second end 86*d* of the cylindrical cam 86 faces the butting surface 81*g*. The driving-force-transmission-member urging spring 84 is a compressed spring, whose first end 84*a* is in contact with a spring seat 83*a* of the driving-force-transmission-member bearing 83, and a second end 84*b* is in contact with a spring seat 81*f* of the driving-force transmission member 81. Thus, the driving-force transmission member 81 is urged to the non-drive side in the axial direction. The urging causes the butting surface 81*g* of the driving-force transmission member 81 to come into contact with (butt) the first end 86*c* of the cylindrical cam 86, so that the driving-force transmission member 81 moves to the drive side together with the movement of the cylindrical cam 81 to the drive side in the longitudinal direction AM, described above. The drive gear 105 that supplies the driving force to the driving-force transmission member 81 is in engagement with the second gear portion (second helical gear portion) 81*e* of the driving-force transmission member 81. The drive gear 105 and the second gear portion 81*e* have a facewidth so as to maintain the engaged state in the entire region in which the driving-force transmission member 81 can move in the longitudinal direction AM. In other words, by opening or closing the openable cover 13, the driving-force transmission member 81 can move in the longitudinal direction AM while maintaining the engagement with the drive gear 105. Thus, the driving-force transmission member 81 moves to the drive side in the longitudinal direction AM by opening the openable cover 13 to come to the retracted position in a state in which the openable cover 13 is open. Thus, the space for mounting the cartridge B can be provided.

Mounting Cartridge B to Apparatus Main Body A

Figure 16A:
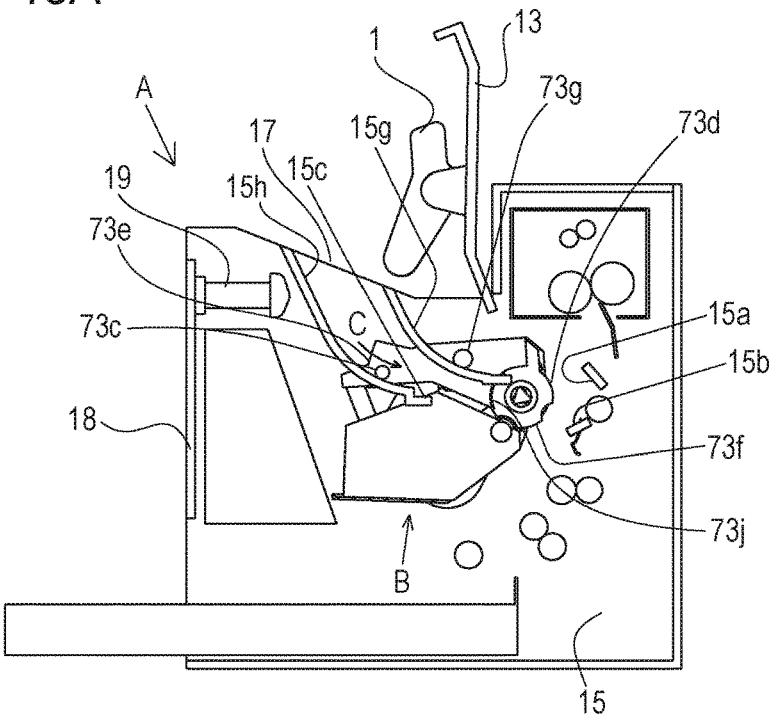
FIG. 16A is a diagram illustrating a configuration, on the drive side of the apparatus main body, in which the cartridge is mounted to the apparatus main body.
Figure 16B:
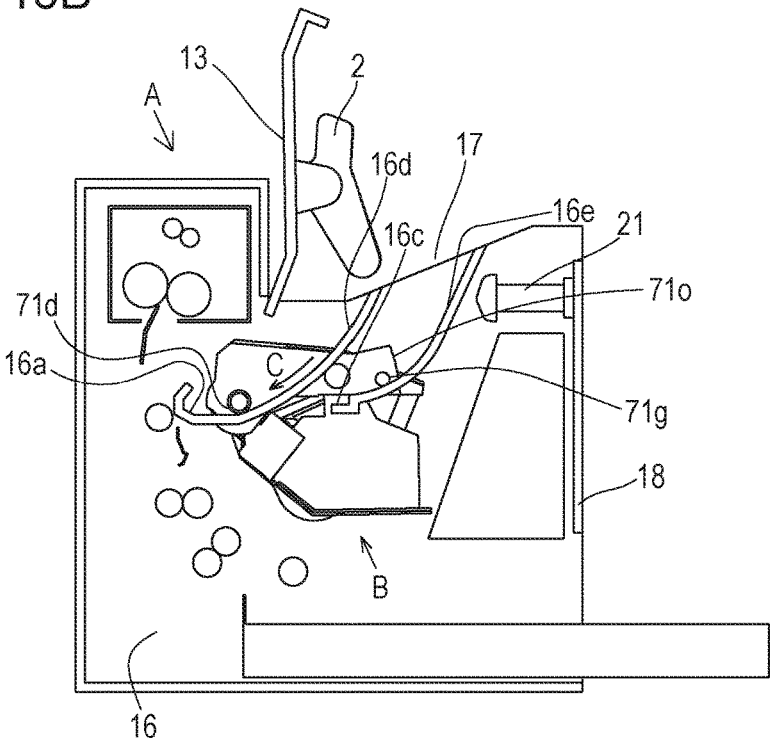
FIG. 16B is a diagram illustrating a configuration, on the non-drive side of the apparatus main body, in which the cartridge is mounted to the apparatus main body.

Next, mounting of the cartridge B will be described. FIG. 16A is a diagram illustrating a configuration, on the drive side of the apparatus main body A, in which the cartridge B is mounted to the apparatus main body A. FIG. 16B is a diagram illustrating a configuration, on the non-drive side of the apparatus main body A, in which the cartridge B is mounted to the apparatus main body A. As illustrated in FIGS. 16A and 16B, the side plate 15 includes the upper guide rail 15*g* and the lower guide rail 15*h* serving as guides, and the side plate 16 includes the upper guide rail 16*d* and the lower guide rail 16*e*. The cartridge B includes a guided portion 73*g* and a rotation-stopped portion 73*c* at the drive-side end and includes a positioned portion 71*d* and a rotation-stopped portion 71*g* at the non-drive-side end. When the cartridge B is inserted from the cartridge insertion opening 17 of the apparatus main body A, the guided portion 73*g* and the rotation-stopped portion 73*c* of the cartridge B on the drive side are respectively guided by the upper guide rail 15*g* and the lower guide rail 15*h* of the apparatus main body A. The positioned portion 71*d* and the rotation-stopped portion 71*g* of the cartridge B on the non-drive side are respectively guided by the upper guide rail 16*d* and the lower guide rail 16*e* of the apparatus main body A. Thus, the cartridge B is mounted to the apparatus main body A by moving in the apparatus main body A while being guided.

Figure 18A:
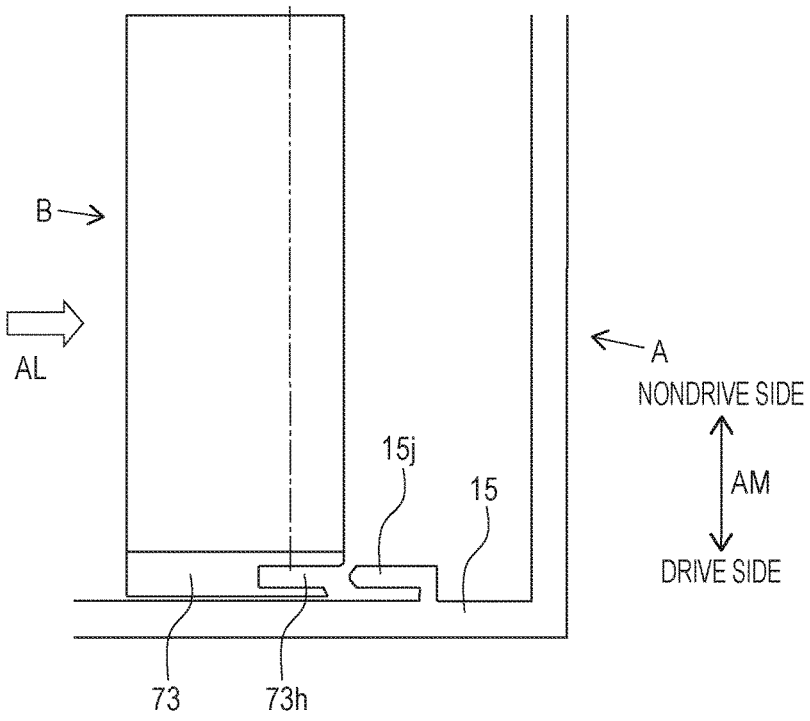
FIG. 18A is a diagram illustrating the position of the cartridge in the longitudinal direction with respect to the apparatus main body.
Figure 18B:
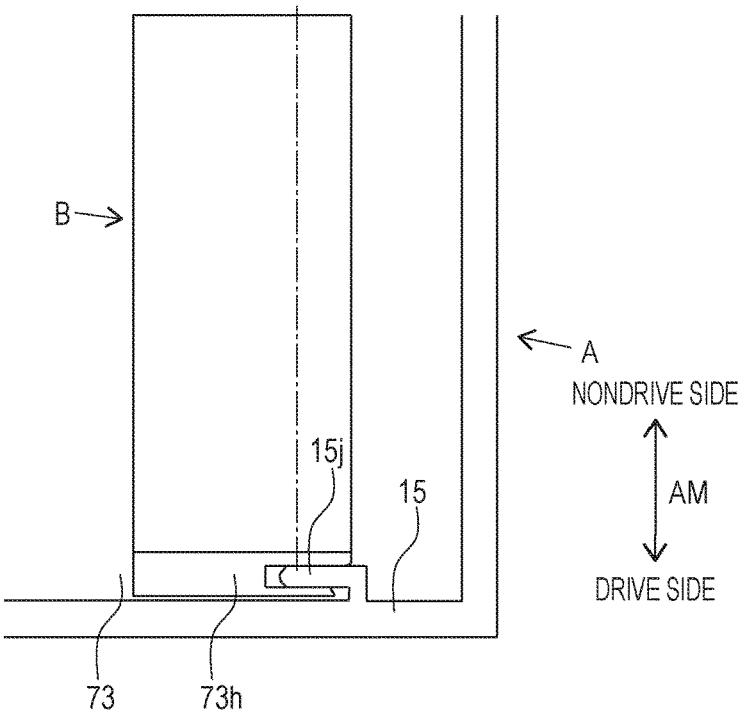
FIG. 18B is a diagram illustrating the position of the cartridge in the longitudinal direction with respect to the apparatus main body.

The cartridge B is positioned in the apparatus main body A in the longitudinal direction AM in the process of mounting described above. FIGS. 18A and 18B are diagrams illustrating the positioning of the cartridge B in the longitudinal direction AM with respect to the apparatus main body A. As illustrated in FIG. 18A, the cartridge B includes a fitting portion 73*h* as a positioning portion. The side plate 15 includes a fitted portion 15*j* that can be fitted in the fitting portion 73*h*. The cartridge B is positioned in the longitudinal direction AM when the fitting portion 73*h* of the cartridge B is fitted on the fitted portion 15*j* of the apparatus main body A in the process of moving in a mounting direction AL while being guided in the apparatus main body A, as illustrated in 18B. The mounting direction AL is a direction crossing the longitudinal direction AM and, in the present embodiment, a direction perpendicular to the longitudinal direction AM.

Arrangement of Driving-Force Transmission Member 81 and Cartridge B

Figure 9:
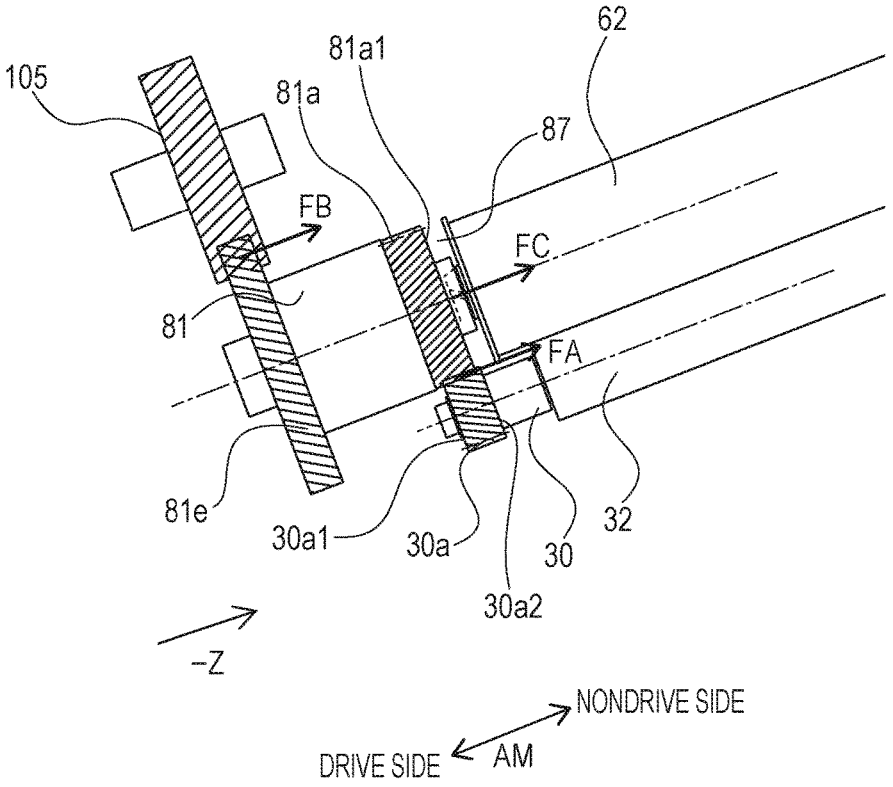
FIG. 9 is a diagram illustrating thrust forces applied to the driving-force transmission member.

Next, the arrangement of the driving-force transmission member 81 and the cartridge B will be described. FIG. 8 is a partial perspective view of the drive side of the cartridge B. FIG. 9 is a diagram illustrating thrust forces applied to the driving-force transmission member 81. As illustrated in FIGS. 8 and 9, a developing roller gear 30 is provided at one end of the developing roller 32 in the longitudinal direction AM. A space 87 is present between the drum 62 of the cartridge B and the driving-force transmission member 81. This space 87 is larger than the first gear portion 81*a* of the driving-force transmission member 81 illustrated in FIG. 7. Therefore, when the cartridge B is mounted to the apparatus main body A, the first gear portion 81*a* fits in the space 87, as illustrated in FIG. 9.

As illustrated in FIGS. 8 and 9, the developing roller gear 30 includes a gear portion (driven gear) 30*a* and an end face 30*a*1 on the drive side of the gear portion. As illustrated in FIGS. 7 and 9, the driving-force transmission member 81 includes the first gear portion 81*a* for driving the developing roller gear 30 and an end face 81*a*1 on the non-drive side of the gear portion 81*a*. As illustrated in FIG. 8, the end face 30*a*1 of the gear portion 30*a* of the developing roller gear 30 is disposed on the drive side with respect to the distal end 63*b*1 of a coupling protrusion (cartridge coupling) 63*b* of the drive-side drum flange 63 in the longitudinal direction AM.

As illustrated in FIG. 17, the end face 81*a*1 of the first gear portion 81*a* of the driving-force transmission member 81 is disposed on the non-drive side with respect to the end face position 30*a*1 of the gear portion 30*a* of the developing roller gear 30 even when the openable cover is open. This enables the gear portion 30*a* of the developing roller gear 30 and the first gear portion 81*a* of the driving-force transmission member 81 to engage with each other in the process of mounting the cartridge B to the apparatus main body A, described above.

Figure 10:
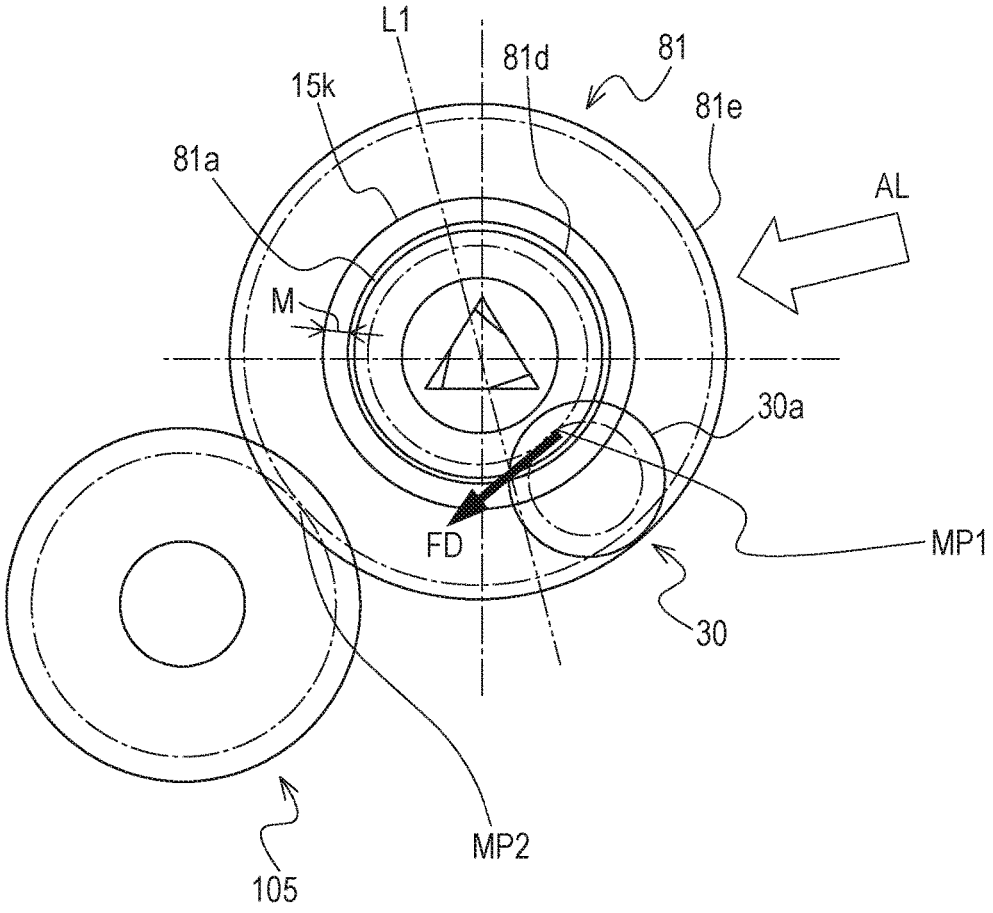
FIG. 10 is a diagram of the vicinity of the driving-force transmission member as viewed in the direction of the axis of rotation of the drum.

FIG. 10 is a diagram of the driving-force transmission member 81, the developing roller gear 30, and the drive gear 105 in a state in which the cartridge B is mounted to the apparatus main body A as viewed in the longitudinal direction AM. The cartridge B is inserted along the guide rails of the apparatus main body A from the direction of arrow AL. In other words, the arrow AL indicates the mounting direction of the cartridge B. The developing roller gear 30 in the cartridge B passes through the center of the driving-force transmission member 81 and is positioned upstream in the mounting direction AL from a straight line L1 perpendicular to the arrow AL. The drive gear 105 that applies the driving force to the driving-force transmission member 81 is positioned downstream from the straight line L1 in the mounting direction AL. As described above, the central portion 81*d* of the driving-force transmission member 81 is movably held in the hole 15*k* of the side plate 15, with the clearance M provided therefrom.

A portion where the developing-roller gear portion 30*a* and the first gear portion 81*a* engage with each other is referred to as an engaging portion MP1, and a portion where the second gear portion 81*e* and the drive gear 105 engage with each other is referred to as an engaging portion MP2. When the cartridge B is mounted, the developing roller gear portion 30*a* comes into contact with the first gear portion 81*a* at the engaging portion MP1 to apply a repulsive force in a repulsive direction FD, so that the driving-force transmission member 81 moves in the repulsive direction FD. Since the engaging portion MP1 is located upstream from the straight line L1 in the mounting direction AL, the vector of the repulsive direction FD contains the component of the mounting direction AL. The drive gear 105 is located downstream in the moving direction (repulsive direction FD) of the driving-force transmission member 81, and the engaging portion MP2 is located downstream from the straight line L1 in the mounting direction AL. This allows the engagement of the second gear portion 81*e* and the drive gear 105 to be maintained even if the driving-force transmission member 81 receives the repulsive force, reliably transmitting the driving force from the motor 104 to the second gear portion 81*e*.

Operation of Closing Door 13

Figure 19A:
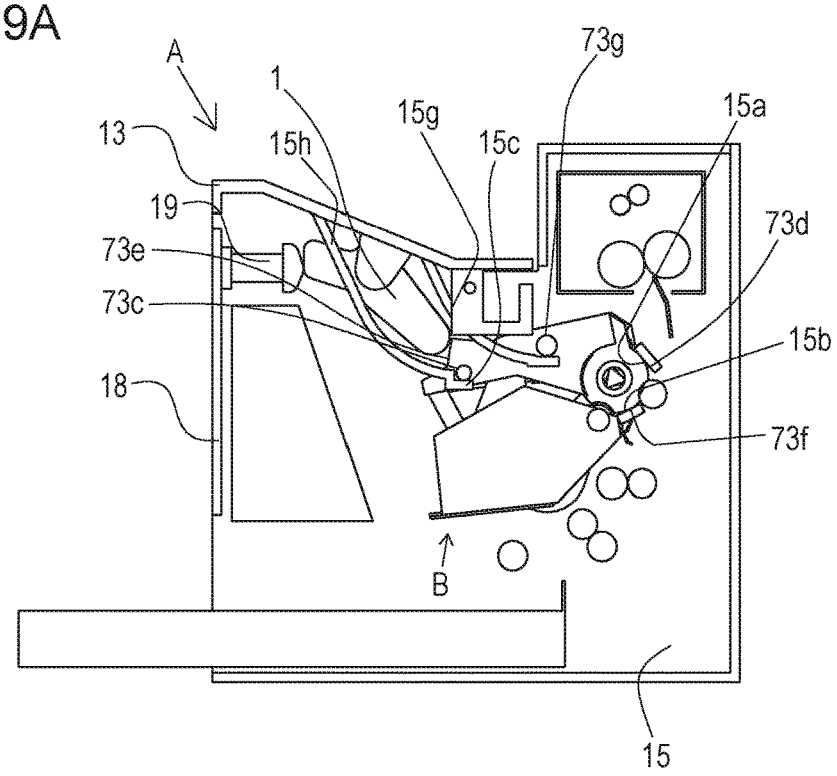
FIG. 19A is a cross-sectional view of the apparatus main body on the drive side illustrating a configuration in which the cartridge is positioned in the apparatus main body in a direction perpendicular to the axis of rotation of the drum.
Figure 19B:
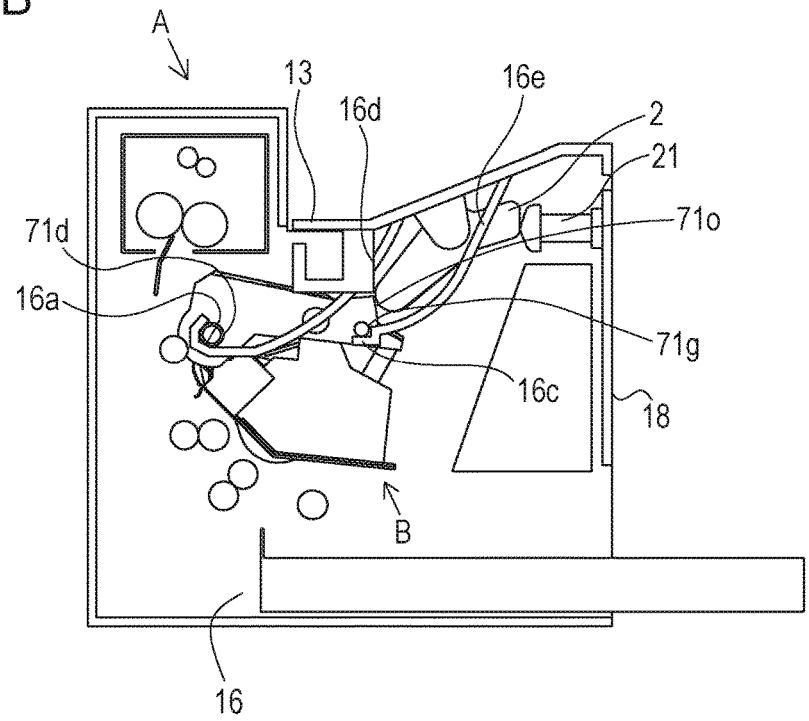
FIG. 19B is a cross-sectional view of the apparatus main body on the non-drive side illustrating a configuration in which the cartridge is positioned in the apparatus main body in the direction perpendicular to the axis of rotation of the drum.

Next, a state in which the operable cover 13 is closed after the cartridge B is mounted to the apparatus main body A and the cartridge B is positioned at a predetermined position will be described. FIG. 16A is a diagram illustrating a configuration, on the drive side of the apparatus main body A, in which the cartridge B is mounted to the apparatus main body A. FIG. 16B is a diagram illustrating a configuration, on the non-drive side of the apparatus main body A, in which the cartridge B is mounted to the apparatus main body A. FIGS. 16A and 16B illustrate a state in which the openable cover 13 is open, and the cartridge B has not yet come into contact with the positioning portion. FIG. 19A is a cross-sectional view of the apparatus main body A on the drive side illustrating a configuration in which the cartridge B is positioned in the apparatus main body A in a direction perpendicular to the axis of rotation of the drum 62. FIG. 19B is a cross-sectional view of the apparatus main body A on the non-drive side illustrating a configuration in which the cartridge B is positioned in the apparatus main body A in the direction perpendicular to the axis of rotation of the drum 62. FIGS. 19A and 19B illustrate a state in which the openable cover 13 is closed, and the cartridge B is in contact with the positioning portion.

The side plate 15 includes a first positioning portion 15*a* and a second positioning portion 15*b* serving as positioning portions and a rotation stopping portion 15*c*. The side plate 16 includes a positioning portion 16*a* and a rotation stopping portion 16*c*. The cartridge B includes a first positioning portion 73*d* and a second positioning portion 73*f* at the drive-side end. The cartridge pressing members 1 and 2 are rotatably attached to both ends of the openable cover 13 in the longitudinal direction. The cartridge pressing springs 19 and 21 are attached to both ends in the longitudinal direction of the front plate 18 of the apparatus main body A. The cartridge B includes pressed portions 73*e* and 71*o* serving as urging-force receiving portions at positions facing the cartridge pressing members 1 and 2.

As illustrated in FIGS. 19A and 19B, by closing the openable cover 13, the pressed portions 73*e* and 71*o* of the cartridge B are respectively pressed by the cartridge pressing members 1 and 2 urged by the cartridge pressing springer 19 and 21 of the apparatus main body A. This allows, on the drive side, the first positioning portion 73*d*, the second positioning portion 73*f*, and the rotation-stopped portion 73*c* of the cartridge B to be positioned by respectively coming into contact with the first positioning portion 15*a*, the second positioning portion 15*b*, and the rotation stopping portion 15*c* of the apparatus main body A. On the non-drive side, the positioned portion 71*d* and the rotation-stopped portion 71*g* of the cartridge B are positioned by respectively coming into contact with the positioning portion 16*a* and the rotation stopping portion 16*c* of the apparatus main body A.

Figure 20:
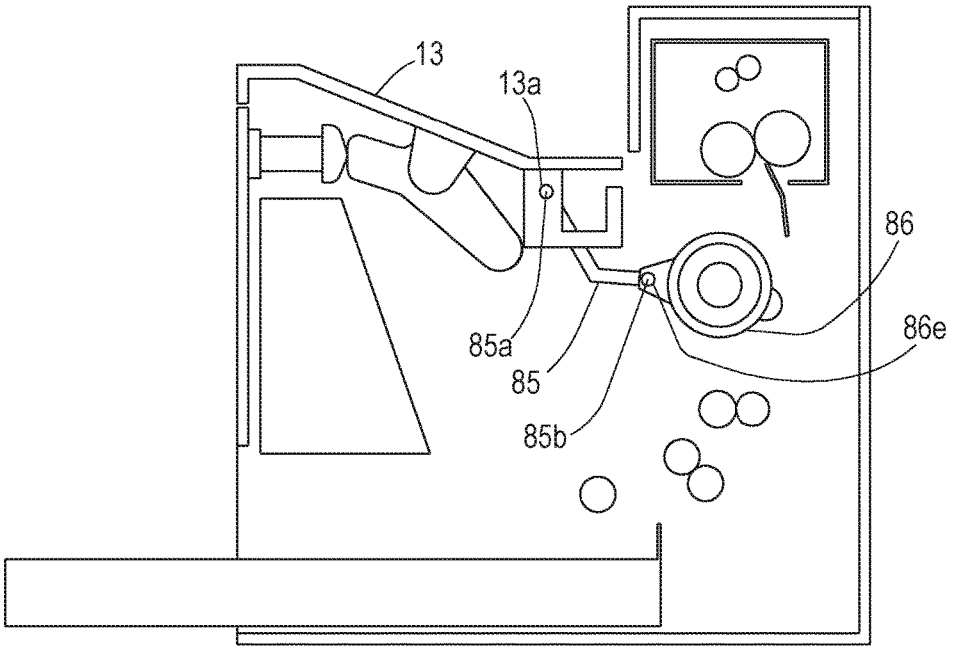
FIG. 20 is a cross-sectional view of the apparatus main body perpendicular to the axis of rotation of the drum for illustrating the link configuration of the cylindrical cam, with the openable cover closed.
Figure 21:
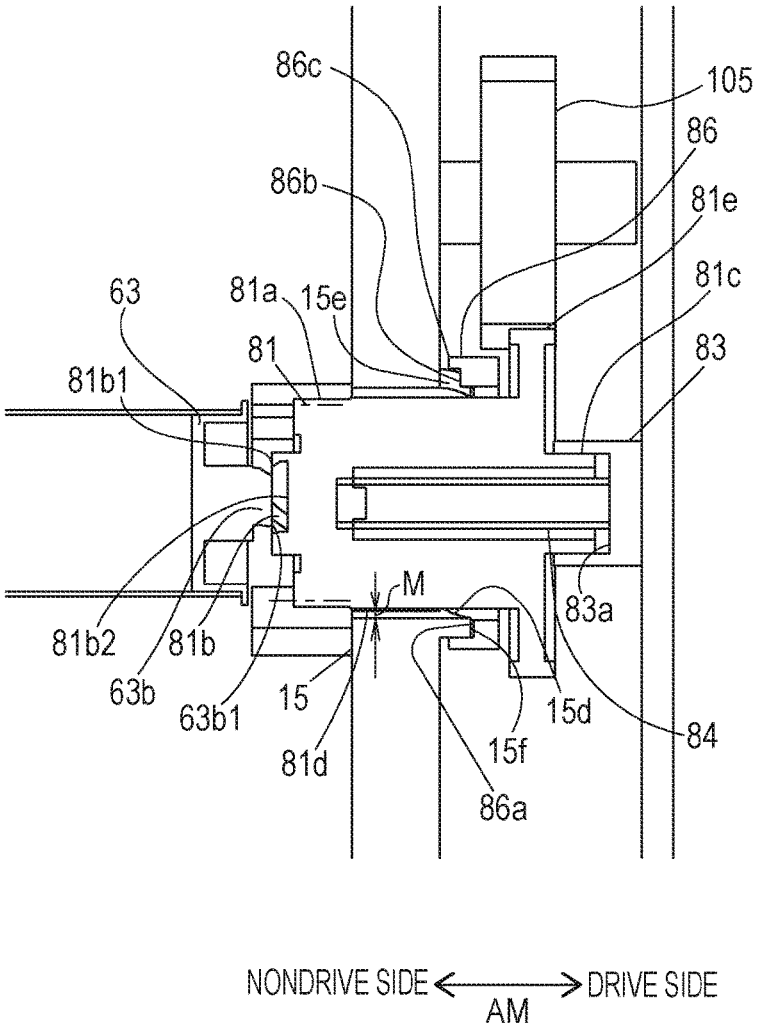
FIG. 21 is a cross-sectional view of the apparatus main body parallel to the axis of rotation of the drum for illustrating movement of the driving-force transmission member.

FIG. 20 is a cross-sectional view of the apparatus main body A perpendicular to the axis of rotation of the drum 62 for illustrating the link configuration of the cylindrical cam 86, with the openable cover 13 closed. FIG. 21 is a cross-sectional view of the apparatus main body A parallel to the axis of rotation of the drum 62 for illustrating movement of the driving-force transmission member 81. As illustrated in FIGS. 20 and 21, the drive-side drum flange 63 of the cartridge B includes the coupling protrusion 63*b* on the drive side and includes the distal end 63*b*1 at the distal end of the coupling protrusion 63*b*. By closing the openable cover 13, the cylindrical cam 86 moves to the non-drive side in the longitudinal direction AM via the link member 85 while the inclined surfaces 86*a* and 86*b* are respectively rotating along the inclined surfaces 15*d* and 15*e* of the side plate 15. This causes the driving-force transmission member 81 at the retracted position to move to the non-drive side in the longitudinal direction AM due to the driving-force-transmission-member urging spring 84. The first gear portion 81*a* of the driving-force transmission member 81 and the developing roller gear 30 of the cartridge B have already been engaged with each other. Since the first gear portion 81*a* and the developing roller gear 30 are helical gears, they do not move further in the rotation direction after moving by the amount of play of the gears.

In the state illustrated in FIG. 21, the phases of the triangles of the coupling recess 81*b* and the coupling protrusion 63*b* are not aligned. Therefore, the movement of the driving-force transmission member 81 in the longitudinal direction AM is stopped because the distal end 81*b*1 of the driving-force transmission member 81 butts against the distal end 63*b*1 of the coupling protrusion 63*b*.

Thrust Force Applied to Driving-Force Transmission Member 81

Figure 22:
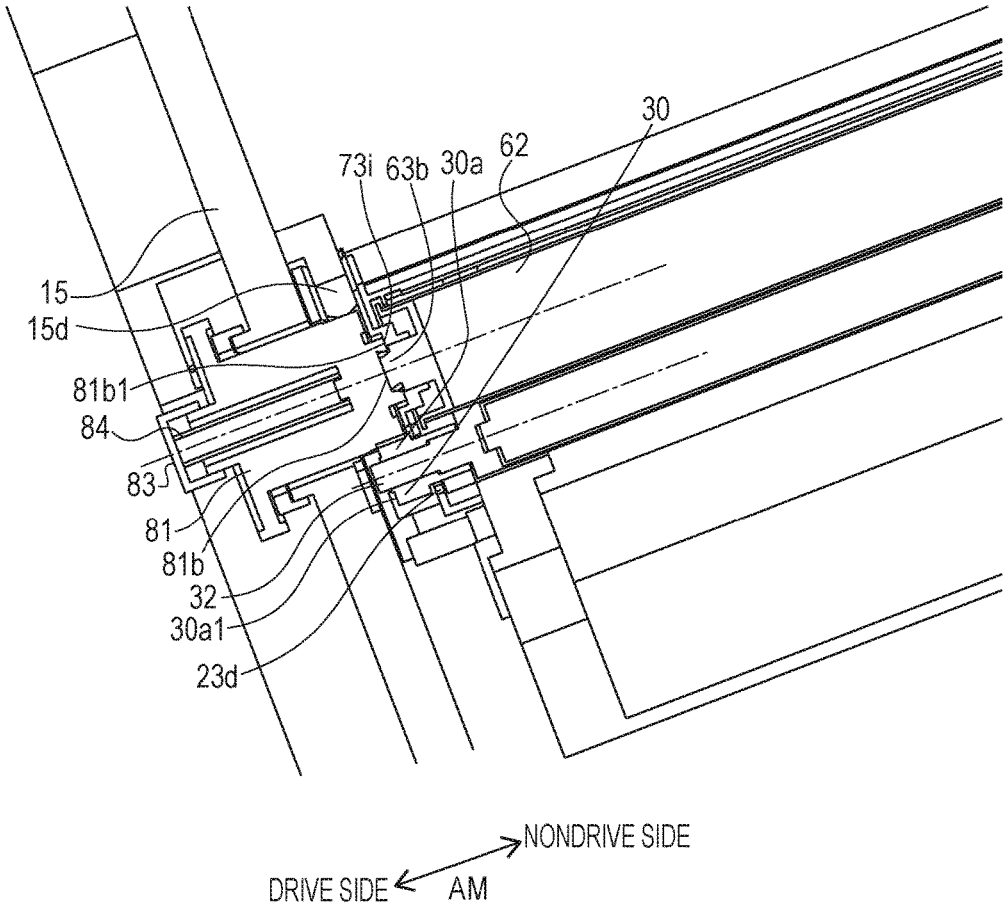
FIG. 22 is a cross-sectional view of the driving-force transmission member and the cartridge parallel to the axis of rotation of the drum for illustrating engagement thereof.

Referring next to FIGS. 7, 8, 9, and 22, a thrust force in the longitudinal direction applied to the driving-force transmission member 81 will be described. FIG. 22 is a cross-sectional view of the driving-force transmission member 81 and the cartridge B parallel to the axis of rotation of the drum 62 for illustrating engagement thereof.

As illustrated in FIG. 8, the drum bearing 73 includes a recessed bottom surface 73*i*. As illustrated in FIG. 7, the driving-force transmission member 81 includes a bottom 81*b*2 as a positioning portion on the bottom of the coupling recess 81*b*.

Next, the twisting directions of the coupling recess 81*b*, the first gear portion 81*a*, and the second gear portion 81*e* will be described. Let a direction parallel to the longitudinal direction AM and directed from the non-drive side to the drive side be +Z-direction (a predetermined direction), a counterclockwise direction viewed in the +Z-direction be N, and a rotation direction when the driving-force transmission member 81 is driven by the motor 104 be R (opposite to the counterclockwise direction N).

The coupling recess 81*b* of the driving-force transmission member 81 is a twisted triangular prismatic hole whose cross section is triangular in shape. The side of the twisted triangular hole is a driving-force transmission surface 81*b*3. The driving-force transmission surface 81*b*3 of the coupling recess 81*b* is twisted in the same direction as the rotation direction R from the downstream side to the upstream side in the +Z-direction, as viewed in the +Z-direction. "As viewed in the +Z-direction" stands for when the driving-force transmission member 81 is viewed from the coupling protrusion 63*b* (cartridge coupling) of the cartridge B mounted to the apparatus main body A.

The first gear portion 81*a* of the driving-force transmission member 81 is a helical gear. The helical teeth are twisted in the same direction as the rotation direction R from the downstream side to the upstream side in the +Z-direction as viewed in the +Z-direction. In other words, the helical teeth of the first gear portion 81*a* are twisted in the same direction as that of the driving-force transmission surface 81*b*3. The second gear portion 81*e* of the driving-force transmission member 81 is a helical gear. The helical teeth are twisted in a direction opposite to the rotation direction R from the downstream side to the upstream side in the +Z-direction as viewed in the +Z-direction. The drive gear 105 that transmits the driving force from the motor 104 serving as a drive source to the second gear portion 81*e* of the driving-force transmission member 81 is a helical gear, and the helical teeth are twisted in a direction opposite to that of the helical teeth of the second gear portion 81*e*. The pitch circle radius of the first gear portion 81*a* is larger than the maximum radius of the driving-force transmission surface 81*b*3 in the radial direction centered on the rotation center of the driving-force transmission member 81.

Next, the torsional directions of the coupling protrusion 63*b* and the gear portion 30*a* will be described. A direction parallel to the longitudinal direction AM and directed from the drive side to the non-drive side is referred to as −Z-direction. Let a clockwise direction viewed in the −Z-direction be O (centered on the coupling protrusion 63*b*) and P (centered on the developing roller gear 30).

As illustrated in FIG. 8, the coupling protrusion 63*b* of the drive-side drum flange 63 has a twisted triangular prismatic protruding shape that is triangular in cross section, which is twisted in the clockwise direction O from the upstream side to the downstream side in the −Z-direction as viewed in the −Z-direction. The gear portion 30*a* of the developing roller gear 30 is a helical gear, whose helical teeth are twisted in the clockwise direction P from the upstream side to the downstream side in the −Z-direction as viewed in the −Z-direction.

When the drive gear 105 is rotated in the rotation direction R by the motor 104, the driving-force transmission member 81 is urged in the −Z-direction by a thrust force FB in the −Z-direction of the force of engagement between the second gear portion 81*e* of the driving-force transmission member 81 and the drive gear 105, as illustrated in FIG. 9. The driving-force transmission member 81 is also urged in the −Z-direction by a thrust force FA in the −Z-direction of the force of engagement between the first gear portion 81*a* of the driving-force transmission member 81 and the gear portion 30*a* of the developing roller gear 30. As illustrated in FIG. 22, when the phases of the rectangles of the coupling recess 81*b* and the coupling protrusion 63*b* align, the driving-force transmission member 81 moves to the non-drive side to engage the coupling protrusion 63*b* and the coupling recess 81*b* with each other. Furthermore, since the driving-force transmission member 81 moves to the non-drive side, the distal end 81*b*1 of the driving-force transmission member 81 comes into contact with the recessed bottom surface 73*i* of the drum bearing 73 and is positioned in the longitudinal direction AM. At that time, the driving-force transmission member 81 is at the engaging position.

Referring to FIG. 9, the driving-force transmission member 81 also receives a thrust force FC in the −Z-direction due to the twist between the coupling recess 81*b* and the coupling protrusion 63*b*. In other words, the driving-force transmission member 81 receives a force that moves the driving-force transmission member 81 to one side (the non-drive side) in the longitudinal direction AM from each of the thrust forces FA, FB, and FC. The distal end 63*b*1 of the coupling protrusion 63*b* is brought into contact with the bottom 81*b*2 of the coupling recess 81*b* by the reaction of the thrust force FC, so that the drum 62 is positioned. The axis of rotation of the driving-force transmission member 81 with respect to the drive-side drum flange 63 is determined by the alignment effect of the contact between the coupling recess 81*b* and the coupling protrusion 63*b* at three places. The clearance M between the hole 15*k* of the side plate 15 and the central portion 81*d* of the driving-force transmission member 81, described with reference to FIG. 15, has an amount that does not interfere with the driving-force transmission member 81 whose axis of rotation has been determined. This allows the driving-force transmission member 81 to accurately transmit the driving force to the developing roller gear 30*a* and the drive-side drum flange 63.

As described above, the thrust forces FA, FB, and FC that act on the driving-force transmission member 81 during driving act in the same direction (−Z-direction) in the longitudinal direction AM. This causes the driving-force transmission member 81 to come into contact with a predetermined longitudinal positioning portion (in the present embodiment, the recessed bottom surface 73*i* of the cartridge B positioned in the longitudinal direction AM with respect to the side plate 15) so that its position in the longitudinal direction AM is determined. In other words, all of the thrust forces FA, FB, and FC function as forces to butt the driving-force transmission member 81 to the predetermined longitudinal positioning portion. This enables the driving-force transmission member 81 to butt against the predetermined positioning portion with stability. This allows the spring force of the driving-force-transmission-member spring 84 that urges the driving-force transmission member 81 to the non-drive side in the longitudinal direction AM to be set extremely small, thereby decreasing the force to operate the openable cover 13. In other words, the spring force of the driving-force-transmission-member spring 84 has only to bring the butting surface 81*g* into contact with the first end 86*c* of the cylindrical cam 86 to retract the driving-force transmission member 81 during non-driving during which the thrust forces FA, FB, and FC are not generated.

In the above embodiment, the predetermined positioning portion against which the driving-force transmission member 81 butts is the recessed bottom surface 73*i* of the drum bearing 73 of the cartridge B positioned with respect to the side plate 15, as illustrated in FIG. 18B. However, the predetermined positioning portion against which the driving-force transmission member 81 butts is not limited to the recessed bottom surface 73*i*. For example, the predetermined positioning portion against which the driving-force transmission member 81 butts may be provided on the side plate 15.

Next, positioning of the driving-force transmission member 81 in the longitudinal direction AM by the recessed bottom surface 73*i* of the drum bearing 73 of the cartridge B positioned with respect to the side plate 15 will be described. This increases the positional accuracy in the longitudinal direction AM of the driving-force transmission member 81, the coupling protrusion 63*b* of the cartridge B, and the gear portion 30*a* of the developing roller gear 30. If the amount of retraction of the driving-force transmission member 81 in the longitudinal direction AM is made as small as possible, the apparatus main body A can be reduced in size in the longitudinal direction AM. The minimum amount of retraction necessary for preventing the coupling protrusion 63*b* from interfering with the coupling recess 81*b* has been determined. Therefore, the increase in the positional accuracy of the driving-force transmission member 81 and the coupling protrusion 63*b* allows the amount of retraction of the driving-force transmission member 81 to be set as small as possible while ensuring the minimum amount of retraction required, reducing the size of the apparatus main body A in the longitudinal direction AM. By making the amount of retraction of the driving-force transmission member 81 as small as possible, the width of the gear portion 30*a* of the developing roller gear 30 in the longitudinal direction AM can also be made as small as possible.

In the present embodiment, the engaging force of the developing roller gear is used as a force to move the driving-force transmission member 81 to the drive side. Alternatively, an idle gear that drives a load member, such as the developing roller 32 or the first conveying member 43, may also be used for assist.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-118182 filed Jun. 14, 2016, which is hereby incorporated by reference herein in its entirety.

What is claimed is:

1. An electrophotographic image forming apparatus for forming an image on a recording medium, the apparatus comprising:

a cartridge including a first roller that has a cartridge coupling in a longitudinal end of the first roller and a second roller that has a driven gear in a longitudinal end of the second roller; and an apparatus main body to which the cartridge is detachably mountable, the apparatus main body including:

a drive source;

a drive gear configured to be rotated by the drive source; and a driving-force transmission member configured to be rotated by a driving force transmitted from the drive gear to transmit the driving force to the cartridge, wherein the driving-force transmission member includes:

a coupling portion including a driving-force transmission surface configured to engage with the cartridge coupling and transmit the driving force to the cartridge coupling for rotating the first roller;

a first helical gear portion configured to engage with the driven gear to transmit the driving force to the driven gear for rotating the second roller; and a second helical gear portion configured to engage with the drive gear to receive the driving force, wherein the coupling portion, the first helical gear portion, and the second helical gear portion rotate integrally and coaxially with each other when the driving-force transmission member rotates about an axis of rotation, wherein the driving-force transmission surface of the coupling portion has a shape twisted in the same direction as a rotation direction of the driving-force transmission member toward the cartridge coupling in a direction parallel to the axis of rotation, and wherein helical teeth of the first helical gear portion each has a shape twisted in the same direction as a twist direction of the driving-force transmission surface, and helical teeth of the second helical gear portion each has a shape twisted in a direction opposite to the twist direction of the helical teeth of the first helical gear portion.

2. The electrophotographic image forming apparatus according to claim 1, wherein the driving-force transmission member is configured to be movable, in a direction along the axis of rotation, between an engaging position where the coupling portion engages with the cartridge coupling and a retracted position where the coupling portion retracts from the cartridge coupling so that the coupling portion comes out of engagement with the cartridge coupling.

3. The electrophotographic image forming apparatus according to claim 1, wherein, when the driving-force transmission member is at the retracted position, the first helical gear portion can come into engagement with the driven gear.

4. The electrophotographic image forming apparatus according to claim 1, wherein the cartridge is mounted to the apparatus main body in a mounting direction intersecting the axis of rotation, and wherein a portion where the first helical gear portion and the driven gear engage with each other is disposed on a trailing side of the axis of the driving-force transmission member in the mounting direction and a portion where the second helical gear portion and the drive gear engage with each other is disposed on a leading side of the axis of the driving-force transmission member in the mounting direction.

5. The electrophotographic image forming apparatus according to claim 1, wherein the first roller is an electrophotographic photosensitive drum.

6. The electrophotographic image forming apparatus according to claim 5, wherein the second roller is a developer bearing member that supplies a developer to the electrophotographic photosensitive drum.

7. The electrophotographic image forming apparatus according to claim 1, wherein the coupling portion, the first helical gear portion, and the second helical gear portion are disposed in that order in a direction of the axis of rotation.

8. The electrophotographic image forming apparatus according to claim 1, wherein a pitch circle radius of the first helical gear portion is larger than a maximum radius of the driving-force transmission surface in a radial direction centered on a center of rotation of the driving-force transmission member.

9. The electrophotographic image forming apparatus according to claim 1, wherein, when the driving-force transmission member is rotated by a driving force transmitted from the drive source, the driving-force transmission member moves toward the cartridge coupling along the axis of rotation to come into contact with a predetermined positioning portion.

10. An electrophotographic image forming apparatus for forming an image on a recording medium, the apparatus comprising:

a cartridge including a first roller that has a cartridge coupling in a longitudinal end of the first roller and a second roller that has a driven gear in a longitudinal end of the second roller; and an apparatus main body to which the cartridge is detachably mountable, the apparatus main body including:

a drive source;

a drive gear configured to be rotated by the drive source; and a driving-force transmission member configured to be rotated by a driving force transmitted from the drive gear to transmit the driving force to the cartridge, wherein the driving-force transmission member includes:

a coupling portion configured to engage with the cartridge coupling and transmit the driving force to the cartridge coupling for rotating the first roller;

a first helical gear portion configured to engage with the driven gear to transmit the driving force to the driven gear for rotating the second roller; and a second helical gear portion configured to engage with the drive gear to receive the driving force, wherein the coupling portion, the first helical gear portion, and the second helical gear portion rotate integrally and coaxially with each other when the driving-force transmission member rotates about an axis of rotation, and wherein, while the driving-force transmission member is driven by the drive source, the first helical gear portion receives a force to move in a predetermined direction along the axis of rotation by engagement with the driven gear, the second helical gear portion receives a force to move in the predetermined direction along the axis of rotation by engagement with the drive gear, and the coupling portion receives a force to move in the predetermined direction along the axis of rotation by engagement with the cartridge coupling.

11. The electrophotographic image forming apparatus according to claim 10, wherein the driving-force transmission member is configured to be movable, in a direction along the axis of rotation, between an engaging position where the coupling portion engages with the cartridge coupling and a retracted position where the coupling portion retracts from the cartridge coupling so that the coupling portion comes out of engagement with the cartridge coupling.

12. The electrophotographic image forming apparatus according to claim 10, wherein, when the driving-force transmission member is at the retracted position, the first helical gear portion can come into engagement with the driven gear.

13. The electrophotographic image forming apparatus according to claim 10, wherein the cartridge is mounted to the apparatus main body in a mounting direction intersecting the axis of rotation, and wherein, when the apparatus main body to which the cartridge is mounted is viewed in a direction of the axis of rotation, a portion where the first helical gear portion and the driven gear engage with each other is disposed, in the mounting direction, upstream from a straight line passing through a rotation center of the driving-force transmission member and perpendicular to the mounting direction, and a portion where the second helical gear portion and the drive gear engage with each other is disposed downstream from the straight line in the mounting direction.

14. The electrophotographic image forming apparatus according to claim 10, wherein the first roller is an electrophotographic photosensitive drum.

15. The electrophotographic image forming apparatus according to claim 14, wherein the second roller is a developer bearing member that supplies a developer to the electrophotographic photosensitive drum.

16. The electrophotographic image forming apparatus according to claim 10, wherein the coupling portion, the first helical gear portion, and the second helical gear portion are disposed in that order in a direction of the axis of rotation.

17. The electrophotographic image forming apparatus according to claim 10, wherein a pitch circle radius of the first helical gear portion is larger than a maximum radius of the driving-force transmission surface in a radial direction centered on a center of rotation of the driving-force transmission member.

18. The electrophotographic image forming apparatus according to claim 10, wherein, when the driving-force transmission member is rotated by a driving force transmitted from the drive source, the driving-force transmission member moves toward the cartridge coupling along the axis of rotation to come into contact with a predetermined positioning portion.

19. The electrophotographic image forming apparatus according to claim 10, wherein the predetermined direction is a direction toward the cartridge in a direction along the axis of rotation.

* * * * *